US007318280B2

(12) United States Patent
Bayer et al.

(10) Patent No.: US 7,318,280 B2
(45) Date of Patent: Jan. 15, 2008

(54) METHODS FOR DISPLAYING DECORATIVE ORNAMENTS

(75) Inventors: Georg Bayer, Plattsburgh, NY (US); Andrew J. Schonbek, Plattsburgh, NY (US); Carl Tavano, Peru, NY (US); Robin Jarvis, Altona, NY (US); Daniel Tucker, Chazy, NY (US); Timothy Patnode, Peru, NY (US)

(73) Assignee: Schnobek Worldwide Lighting Inc., Plattsburgh, NY (US)

( * ) Notice: Subject to any disclaimer, the term of this patent is extended or adjusted under 35 U.S.C. 154(b) by 328 days.

(21) Appl. No.: 11/048,144

(22) Filed: Feb. 1, 2005

(65) Prior Publication Data

US 2005/0172766 A1 Aug. 11, 2005

Related U.S. Application Data

(63) Continuation-in-part of application No. 10/774,264, filed on Feb. 5, 2004, now Pat. No. 7,261,444.

(51) Int. Cl.
*A44C 27/00* (2006.01)

(52) U.S. Cl. ..... 29/896.4; 29/896.42; 29/896.43; D26/42; D26/54

(58) Field of Classification Search ..... 29/896.4, 29/896.42, 896.43; 362/404–406, 806, 433, 362/457; 24/703.1, 698.3, 574.1, 364, 317; 63/28, 13, 23; 211/85.2; 428/542.2; 248/303; 160/332; D11/12; D26/142–144, 154–155
See application file for complete search history.

(56) References Cited

U.S. PATENT DOCUMENTS 909,405 A * 1/1909 Handel ..... 52/648.1
2,521,006 A 9/1950 Hamilton ..... 224/28
3,214,900 A * 11/1965 Donle ..... 59/82
3,629,571 A 12/1971 Schonbek ..... 240/153
5,104,082 A 4/1992 Bayer ..... 248/303

(Continued)

FOREIGN PATENT DOCUMENTS

DE 1811741 11/1970

(Continued)

*Primary Examiner*—David P. Bryant
*Assistant Examiner*—Alexander P Taousakis
(74) *Attorney, Agent, or Firm*—Heslin Rothenberg Farley & Mesiti P.C.; John Pietrangelo

(57) ABSTRACT

Arrangements and methods for connecting and mounting decorative ornaments, for example, beads, crystals, or gems, are disclosed. The arrangements and methods are particularly useful in mounting ornaments in decorative fixtures, such as chandeliers. In one aspect, an arrangement is provided that includes a first ornament having two mounting apertures and a second ornament having at least one mounting aperture; and at least one connector for connecting the first ornament to the second ornament whereby when hung the two apertures of the first ornament are laterally disposed from each other. Multiple pre-formed connectors are disclosed for use in connecting ornaments, such as ornament chains. Mounting hooks, mounting devices, and mounting arrangements are also provided for attaching ornaments to a support, for instance, mounting devices fabricated from thin plate, for example, by laser cutting. Aspects of the invention may be used for large fixtures, such as large chandeliers, to minimize or prevent the twisting of long chains of ornaments and to support the loading of larger ornaments.

12 Claims, 28 Drawing Sheets

U.S. PATENT DOCUMENTS

| | | | | |
|---|---|---|---|---|
| 5,109,325 | A | 4/1992 | Bayer et al. | 362/433 |
| 5,116,009 | A | 5/1992 | Bayer | 248/303 |
| 5,144,541 | A | 9/1992 | Schonbek | 362/405 |
| 5,181,777 | A * | 1/1993 | Segill et al. | 362/405 |
| 5,241,460 | A | 8/1993 | Schonbek | 362/405 |
| 5,285,364 | A | 2/1994 | Bayer | 362/405 |
| 5,567,046 | A * | 10/1996 | Lucas | 362/405 |
| 5,573,330 | A | 11/1996 | Lucas | 362/405 |
| D397,494 | S | 8/1998 | Bayer et al. | D26/154 |
| 5,906,430 | A | 5/1999 | Bayer | 362/404 |
| 5,921,668 | A | 7/1999 | Bayer | 362/404 |
| 7,018,083 | B2 * | 3/2006 | Lanbach | 362/555 |

FOREIGN PATENT DOCUMENTS

| | | |
|---|---|---|
| DE | 2127913 | 12/1972 |
| DE | 3913470 C1 | 10/1990 |
| EP | 0 200 924 A2 | 11/1986 |

* cited by examiner

METHODS FOR DISPLAYING DECORATIVE ORNAMENTS

CROSS REFERENCE TO RELATED APPLICATIONS

This application is a continuation-in-part application of and claims priority from U.S. application Ser. No. 10/774,264 filed on Feb. 5, 2004 now U.S. Pat. No. 7,261,444 the disclosure of which is incorporated by reference herein in its entirety.

This application is related to the following applications, which are commonly assigned with the above application:

Utility patent application entitled "ARRANGEMENTS, BRACES, AND METHODS FOR SUPPORTING AN ARM OF AN ORNAMENTAL FIXTURE" filed on Feb. 5, 2004 and having Ser. No. 10/773,551 application Ser. No. 10/773,551 is incorporated by reference herein in its entirety.

Utility patent application entitled "DEVICES AND METHODS FOR DISPLAYING DECORATIVE ORNAMENTS" filed on Feb. 1, 2005 and having serial number 11/047,825 application Ser. No. 11/047,825 is also incorporated by reference herein in its entirety.

FIELD OF THE INVENTION

This invention relates, generally, to arrangements for and methods for mounting decorative ornaments, for example, crystals and beads, more particularly, to arrangements and methods for mounting decorative ornaments to lighting fixtures, such as chandeliers.

BACKGROUND OF THE INVENTION

According to prior art practice, ornaments, for example, glass crystals, are typically arranged in chandeliers and other ornamental fixtures using wire-like connectors or connectors produced as stampings from metal sheets or plate. Prior art connectors are typically threaded through perforations in adjacent ornaments to "string" the ornaments together. U.S. Pat. No. 3,629,571 of Schonbek discloses one such connector for arranging ornamental crystals for use in chandeliers, among other fixtures. Though conventional connectors and means for connecting ornaments are very effective when mounting ornaments, conventional connectors can have limitations when providing longer strings of ornaments or connecting larger ornaments, for example, for large chandeliers.

The limitations of conventional ornament connectors are particularly acute as the number and size of ornaments being connected increases, for example, as the size of a chandelier increases. Ever increasing customer demands for larger and more elaborate chandeliers tax the capability and desirability of conventional ornament connectors. For example, the capability and desirability of present ornament connector design is typically exceeded as the size of a chandelier exceeds 10 feet in diameter. For instance, as the diameter of the chandelier increases, the length of a "chain" or "run" of ornaments mounted on the chandelier increases and the tendency for the ornaments to twist or become misaligned increases. Large diameter chandeliers may have runs of ornaments of over 10 feet or more. Such long runs of ornaments are prone to unsightly twisting when conventional connecting methods and connectors are used. The realignment of such twisted chains is typically time consuming and, often, ineffective in providing the proper orientation of the ornaments desired.

Also, as the size of chandeliers increase, the size of the ornaments typically used also increases. This also taxes present ornament connector design. Specifically, as the size of a chandelier increases, the size of the ornaments mounted on the large chandelier must be increased to maintain the aesthetic qualities of the chandelier. For example, small ornaments simply are not aesthetically appealing when mounted on large chandeliers. Large chandeliers are typically mounted in large rooms and are typically viewed from larger distances than small chandeliers. As a result, to ensure that the aesthetics of individual ornaments or chains of ornaments are distinguishable on such large chandeliers, the ornaments themselves must typically be made larger. Typically, as the size of the ornaments increases, the weight of the ornament also increases. The increased weight of larger ornaments, for example, larger glass crystal ornaments, can exceed the load capacity of conventionally connected ornament chains.

The present invention overcomes these and other limitations in prior art ornament connectors, for example, especially for ornaments mounted on large chandeliers.

BRIEF SUMMARY OF ASPECTS OF THE INVENTION

One aspect of the invention is an arrangement for connecting decorative ornaments, the arrangement including a first ornament having at least a first aperture and a second aperture; a second ornament having at least a first aperture; and at least one connector for connecting the first ornament to the second ornament; whereby the second aperture of the first ornament is laterally disposed from the first aperture of the first ornament. In one aspect of the invention, the second ornament comprises a first aperture and a second aperture. In one aspect of the invention, the first ornament may be positioned above the second ornament. In another aspect of the invention, the first ornament may be positioned below the second ornament. In one aspect of the invention, the first ornament comprises at most a first aperture and a second aperture. In one aspect of the invention, the first ornament comprises at most a first aperture, a second aperture, and a third aperture.

Another aspect of the invention is a method of assembling at least a first decorative ornament having a first aperture and a second aperture and a second decorative ornament having one or more apertures, the method including providing a first connector and a second connector, each connector having a first end and a second end; inserting the first end of the first connector into the first aperture of the first ornament; inserting the second end of the first connector into the one or more apertures of the second ornament; securing the first end of the first connector to the first ornament; securing the second end of the first connector to the second ornament; inserting the first end of a second connector into the second aperture of the first ornament; inserting the second end of the second connector into the one or more apertures of the second ornament; securing the first end of the second connector to the first ornament; and securing the second end of the second connector to the second ornament. In one aspect of the invention, the one or more apertures of the second ornament comprises at least a first aperture and a second aperture, and wherein inserting the second end of the second connector into the one or more apertures of the second ornament comprises inserting the second end of the first connector into the second aperture of the second ornament. In one aspect of the invention, the first ornament or the second ornament comprises at most a first aperture and a second aperture. In one aspect of the invention, the first ornament or the second ornament comprises at most a first aperture, a second aperture, and a third aperture.

Another aspect of the invention is a method of assembling at least a first decorative ornament having a first aperture and a second aperture and a second decorative ornament having one or more apertures, the method including providing a first connecting means and a second connecting means; engaging the first connecting means with the first aperture of the first ornament; engaging the first connecting means with the one or more apertures of the second ornament; engaging the second connecting means with the second aperture of the first ornament; and engaging the second connecting means with the one or more apertures of the second ornament. In one aspect of the invention, the connecting means may be wires, rods, pins, or posts, for example, pins or posts fabricated from plate. In one aspect of the invention, the one or more apertures of the second ornament may comprise at least a first aperture and a second aperture, and wherein engaging the second connecting means with the one or more apertures of the second ornament comprises engaging the second connecting means with the second aperture of the second ornament. In one aspect of the invention, the method comprises a method of assembling a concatenation or chain of ornaments, for example, a chain of at least 3 ornaments.

Another aspect of the invention is an arrangement for hanging one or more decorative ornaments, the arrangement including at least one ornament having at least a first aperture and a second aperture; and at least one hook having a first end adapted to be inserted and secured to the first aperture of the ornament, a second end adapted to be inserted and secured to the second aperture of the ornament, and a loop positioned between the first end and the second end, the loop adapted to be hung from a support; wherein, when hung by the loop, the second aperture of the ornament is laterally disposed from the first aperture of the ornament.

A further aspect of the invention is a method of mounting one or more decorative ornaments having a first aperture and a second aperture; the method comprising; providing a hook having a first end, a second end, and a loop positioned between the first end and the second end, the loop adapted to be hung from a support; inserting and securing the first end of the hook into the first aperture; inserting and securing the second end of the hook into the second aperture; hanging the loop of the hook to a support wherein the second aperture of the one or more ornaments is laterally disposed from the first aperture of the one or more ornaments.

A further aspect of the invention is a device for hanging a decorative ornament on a fixture, the decorative ornament having a mounting hook, the device including a plate having an edge; and a channel in the plate having an open first end located at the edge of the plate, a closed second end, and a horizontal section and at least one vertical section located between the open first end and the closed second end; wherein the channel is adapted to receive the hook of the ornament and support the hook in the closed second end of the channel.

A still further aspect of the invention is an arrangement for mounting a decorative ornament on a fixture, the decorative ornament having a preferred direction of orientation; the arrangement including a mounting hook adapted to be attached to the decorative ornament; a plate having a planar surface and an edge; and a channel in the plate having an open first end located at the edge of the plate, a closed second end, and a horizontal section and at least one vertical section located between the open first end and the closed second end; wherein the channel is adapted to receive the hook of the ornament and support the ornament whereby the preferred direction of orientation of the ornament is directed substantially parallel to the planar surface of the plate.

Another aspect of the invention is a method of displaying a plurality of ornaments, each ornament having at least two perforations, the method comprising mounting the plurality of ornaments whereby the at least two perforations of the plurality of ornaments are laterally disposed, for example, disposed in a substantially horizontal direction with respect to each other. In one aspect of the invention, the method comprises a method of displaying a plurality of ornaments in a concatenation, or chain, of ornaments, for example, a chain of at least 3 ornaments. In one aspect of the invention, the method comprises mounting the plurality of ornaments using connecting means, for example, connecting means comprising one or more wires or rods. In one aspect, the method comprises connecting the plurality of ornaments whereby the load on the perforations in the ornaments is reduced compared to conventional methods. In one aspect, the method comprises distributing the weight of the subsequent, for example, lower, ornaments in the chain to the at least two perforations, for example, evenly distributing the weight of the ornaments to the at least two perforations. In one aspect of the invention, the plurality of ornaments, for example, octagon crystals, have only two perforations.

Another aspect of the invention is a device for displaying decorative ornaments, the device including at least one mounting means adapted to mount the device to a support structure; at least one elongated spine mounted to the at least one mounting means; and at least one mounting post projecting from the elongated spine, the at least one mounting post adapted to accept at least one perforated decorative ornament; wherein the mounting means, spine, and mounting post are fabricated from at least one plate. In one aspect, at least two elongated spines may be provided. In another aspect, a plurality of mounting posts may be provided. In one aspect of the invention, the mounting means, spines, and mounting posts may be fabricated by, for example, laser cutting a thin plate, for example, a plate less than about 0.050 inches thick.

Another aspect of the invention is a method for fabricating a device for displaying decorative ornaments, the method including providing a thin plate; and machining the thin plate to provide: at least one elongated spine; and at least one mounting post projecting from the elongated spine, the at least one mounting post adapted to accept at least one perforated decorative ornament. In one aspect, the at least one elongated spine may comprise at least two substantially parallel spines. In another aspect, the at least one mounting post may comprise at least one pair of mounting posts projecting from the at least two substantially parallel spines. Again, in one aspect, machining may comprise laser cutting, for example, laser cutting a thin plate.

Another aspect of the invention is a decorative ornament arrangement including: at least one mounting means adapted to mount the arrangement to a support structure; at least two substantially parallel spines mounted to the at least one mounting means; a plurality of pairs of mounting posts projecting from the parallel spines; and a plurality of perforated ornaments mounted to the plurality of pairs of mounting posts; wherein the mounting means, spines, and mounting posts are fabricated from one plate. In one aspect, the arrangement may be laser cut from thin plate.

A still further aspect of the invention is an connector adapted to couple two or more ornament chains having posts or pins, the connector including at least one cross bar; a plurality of uprights extending from the at least one cross bar; and at least one perforation in each of the plurality of uprights, the at least one perforation adapted to engage the post of the ornament chain. In one aspect of the invention, the connector may assume the form of the letter H, and may be referred to as an "H connector." In one aspect of the invention the connector may be fabricated from plate, for example, from thin plate, for example, by means of laser jet cutting. Another aspect of the invention is a method of fabricating the connector described above, for example, using the procedures of the methods described to fabricate other structures disclosed herein, for instance, the methods of fabricating the device for displaying decorative ornaments discussed above.

Thus, aspects of the present invention provide for arrangements and methods for connecting and mounting ornaments, for example, for mounting and supporting glass ornaments in ornamental lighting fixtures.

BRIEF DESCRIPTION OF FIGURES

The subject matter that is regarded as the invention is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF ASPECTS OF THE INVENTION

The details and scope of the aspects of the present invention can best be understood upon review of the attached figures and their following descriptions.

Figures 1, 2:
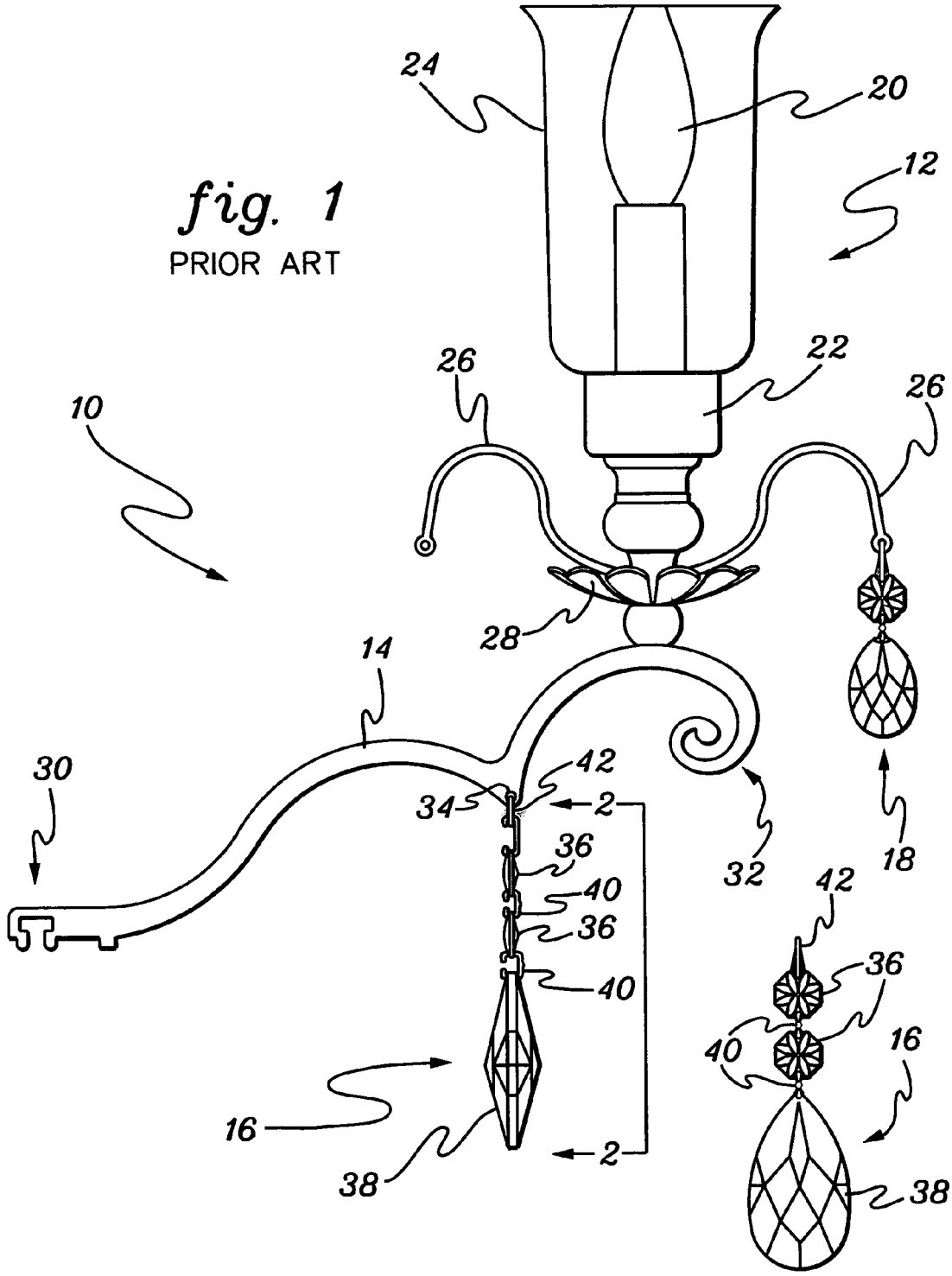
fig. 1 PRIOR ART
fig. 2 PRIOR ART
FIG. 1 is a side elevation view of a fixture mounting assembly having decorative ornaments mounted and connected according to the prior art.
FIG. 2 is a front elevation view of the decorative ornament arrangement shown in FIG. 1 as viewed along lines 2-2.

FIG. 1 is a side elevation view of a fixture mounting assembly 10 having decorative ornaments mounted and connected according to the prior art. Assembly 10 includes a fixture 12, a fixture mounting arm 14, and one or more decorative ornament assemblies 16 and 18. In this typical prior art assembly, fixture 12 is a light fixture having a light bulb 20 mounted in a fixture base 22 and a light shade 24, which in this example is a hurricane light shade, mounted to fixture base 22. Assembly 10 also includes a pair of ornament mounting arms 26 to which ornament assembly 18 is hung and a bobeche 28. Fixture mounting arm 14 includes a first end 30 adapted for mounting to a support, a free second end 32 to which fixture 12 mounted, and an ornament mounting hole 34 to which ornament assembly 16 is mounted.

FIG. 2 is a front elevation view of the decorative ornament arrangement 16 shown in FIG. 1 as viewed along lines 2-2. Ornament assembly 16, and also ornament assembly 18, include a plurality of ornaments 36, 38 connected by conventional connectors 40 and hung by conventional hook 42. Connectors 40 and hook 42 are disclosed in U.S. Pat. No. 3,629,571 of Schonbek.

Figure 3:
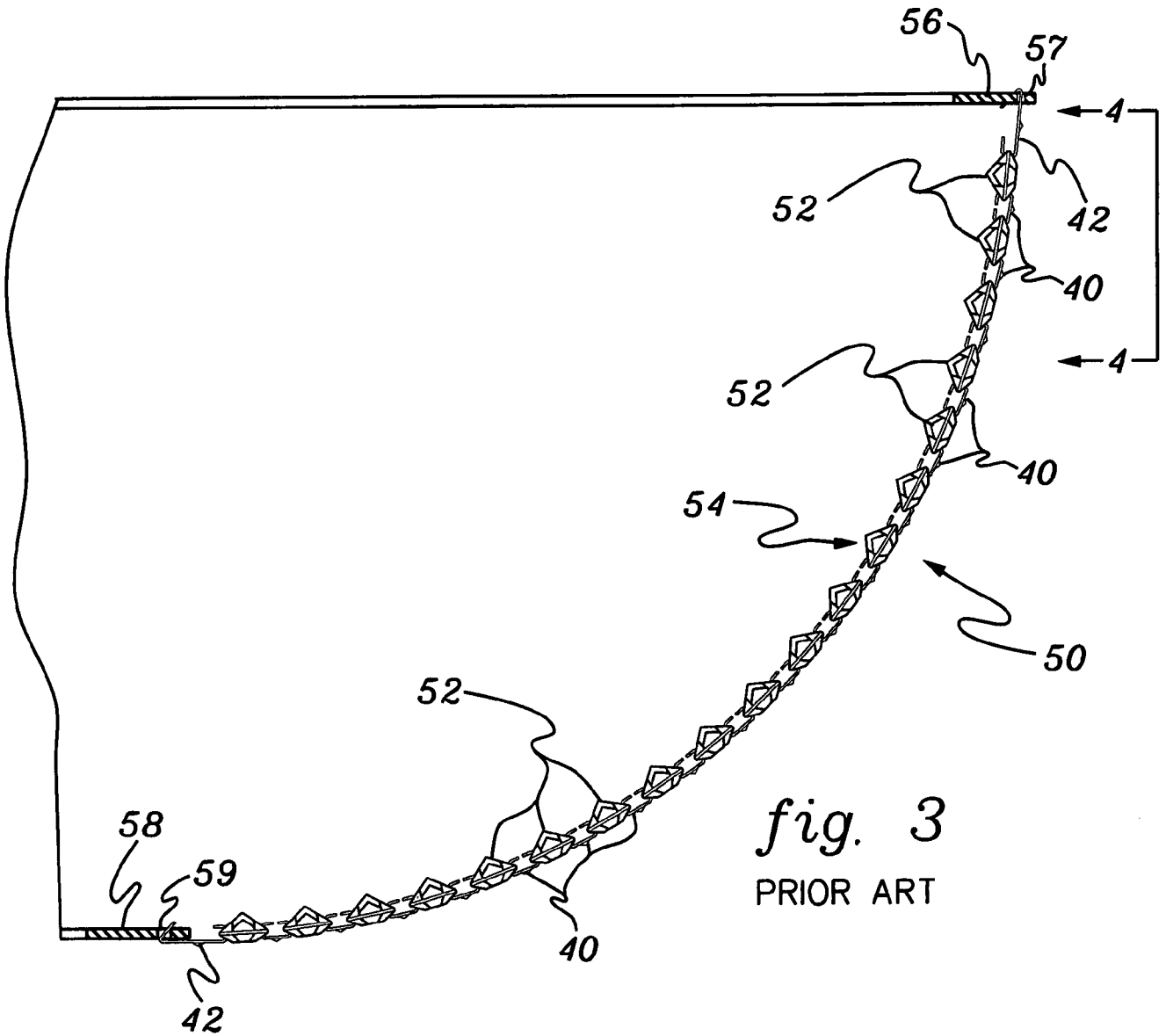
fig. 3 PRIOR ART
FIG. 3 is a side elevation view, partially in cross-section, of an ornament chain mounting having connectors according to the prior art.
Figure 4:
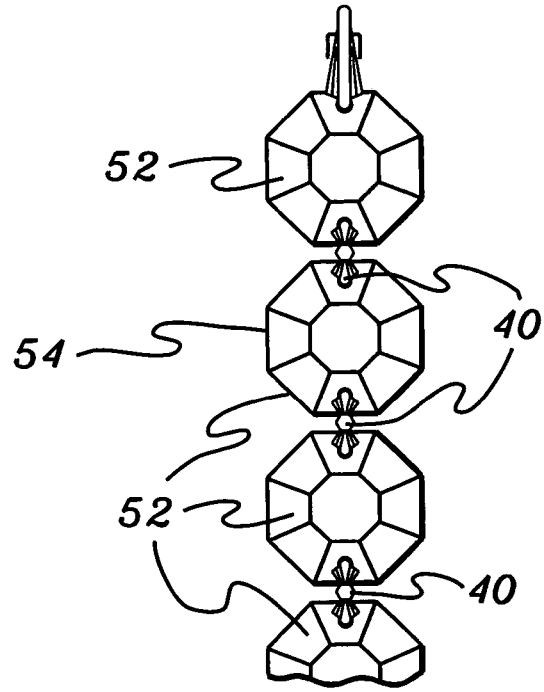
fig. 4 PRIOR ART
FIG. 4 is a partial front elevation view of the decorative ornament chain shown in FIG. 3 as viewed along lines 4-4.

FIG. 3 is a side elevation view, partially in cross-section, of an ornament chain mounting 50 according to the prior art. Chain mounting 50 includes ornaments 52 connected in series to provide a chain 54 using connectors 40 and hooks 42 shown in FIG. 2. Mounting 50 is typically one of a series of identical mountings used to form basket- or bowl-shaped arrangements for decorative fixtures, such as chandeliers. FIG. 4 is a partial front elevation view of the decorative ornament chain 54 shown in FIG. 3 as viewed along lines 4-4. In this typical mounting, chain 54 is mounted to an upper support ring or gallery ring 56, partially shown in cross section, and lower support ring or gallery ring 58, also partially shown in cross section. Gallery rings 56 and 58 typical include a plurality of holes 57 and 59, respectively, to which hooks 42 are attached to mount chain 54.

Figure 5:
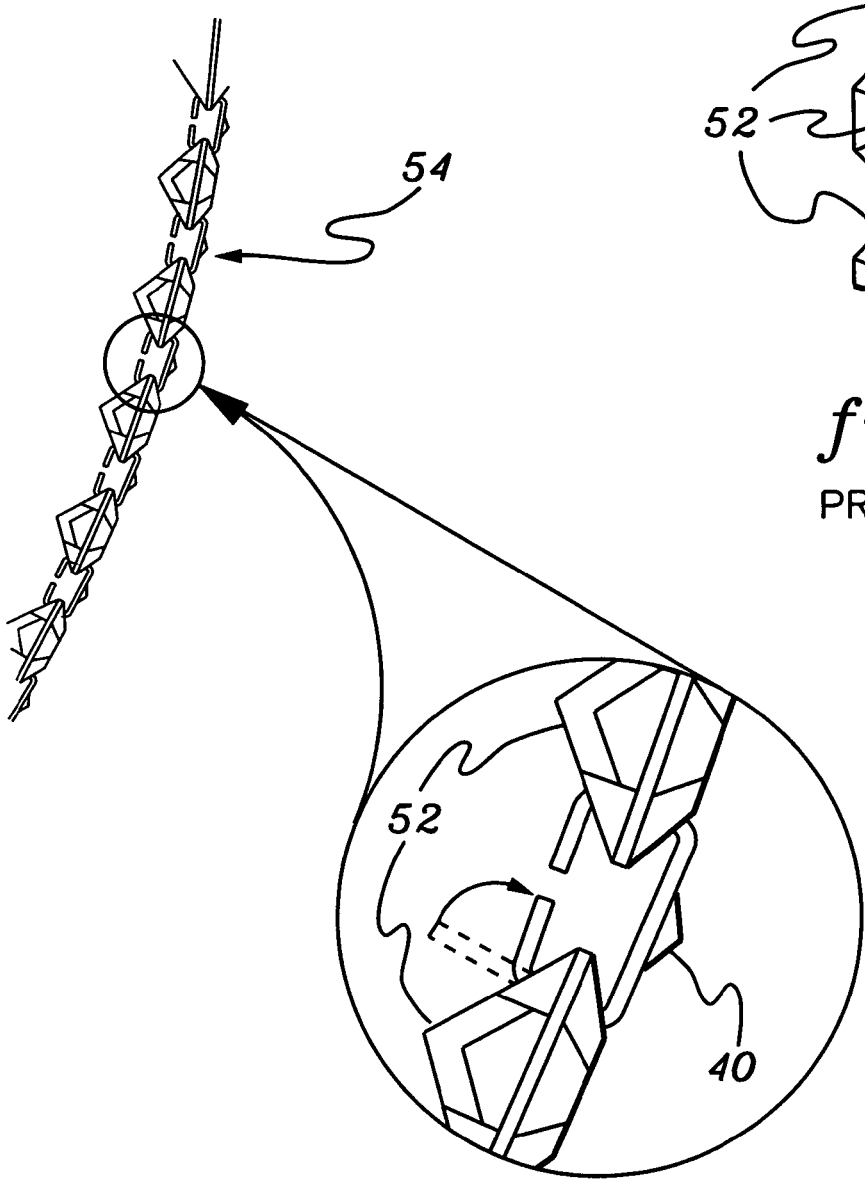
fig. 5 PRIOR ART
FIG. 5 is a detailed view of an ornament connector shown in FIGS. 1 through 4 according to the prior art.

FIG. 5 presents a detailed view of the ornament connector 40 used in the ornament arrangement 16 shown in FIG. 2 and in chain 54 shown in FIG. 3 according to the prior art, and as disclosed in U.S. Pat. No. 3,629,571. Connector 40 includes tangs used to secure the ornaments that are bent in-line with the axis of connector 40, as shown in FIG. 5. Connector 40 provides excellent means for connecting ornaments, for example, in light fixtures or chandeliers. However, aspects of the present invention provide improved connectors and hooks for ornaments, especially when ornaments are mounted in long chains of ornaments or when the weight of the ornaments increases, for example, as is typical in large chandeliers, for instance, chandeliers having diameters of at least 10 feet.

Mounting arrangement 50 shown in FIG. 3 having prior art connectors 40 typically provides excellent support for mounting ornaments 52 into chains 54. However, as the length of chain 54 increases, the potential for twisting or misalignment of ornaments 52 in chain 54 increases. For larger chandeliers, for example, chandeliers having an outside diameter of at least about 10 feet, sometimes, at least about 15 feet, or even at least about 20 feet or more, connectors 40 may not provide sufficient alignment between ornaments 52 whereby chain 54 may become twisted or otherwise misaligned and detract from the overall aesthetic appearance of the chandelier. In addition, as discussed above, as the size of the chandelier increases, the size and weight of the individual ornaments 52 typically also increases. The individual or combined weight of larger ornaments 52 may exceed the load carrying capacity of conventionally connected ornament chains. Aspects of the present invention address these and other disadvantages of the prior art ornament connectors and connecting methods.

Figure 6:
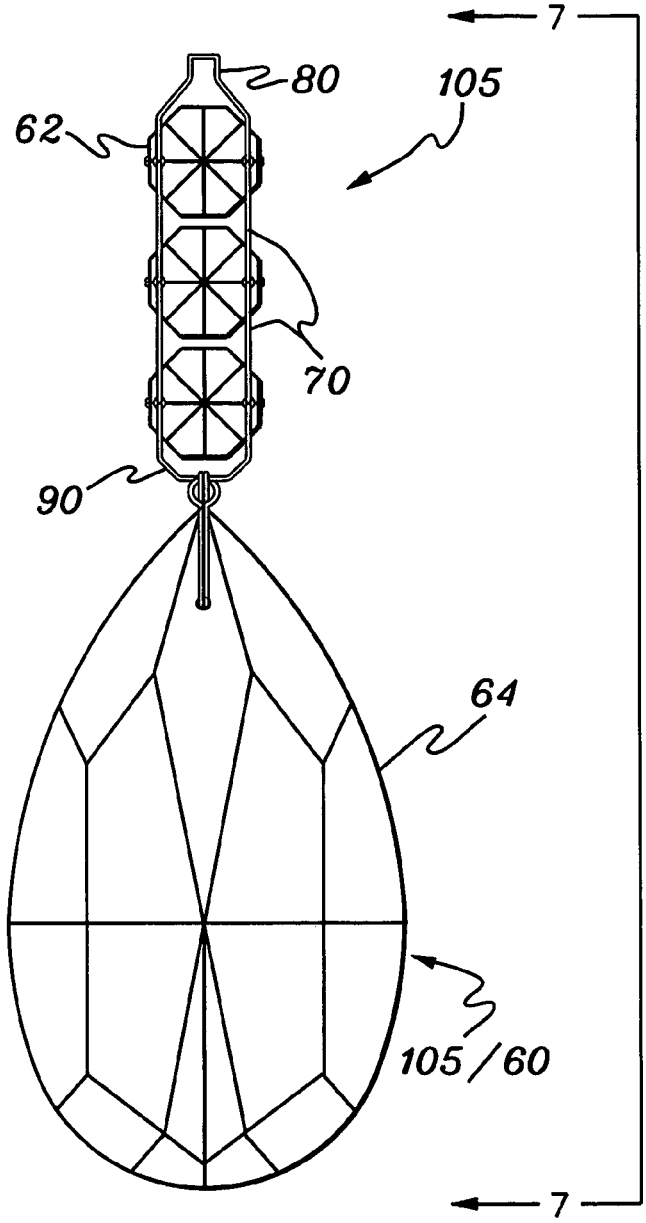
FIG. 6 is a front elevation view of an ornament arrangement having ornaments connected according to one aspect of the present invention.
Figure 7:
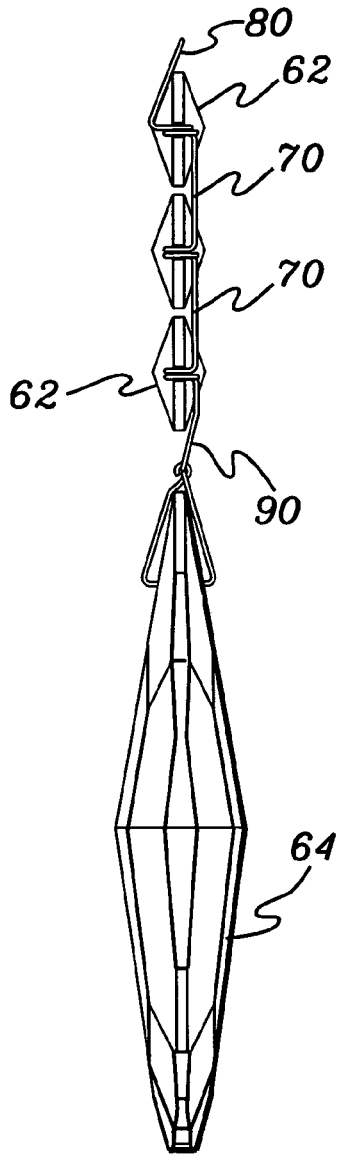
FIG. 7 is a side elevation view of the ornament arrangement shown in FIG. 6 as viewed along lines 7-7.

FIG. 6 is a front elevation view of an ornament arrangement 60 having ornaments 62 and 64 connected according to one aspect of the present invention. FIG. 7 is a side elevation view of ornament arrangement 60 shown in FIG. 6 as viewed along lines 7-7. According to this aspect of the invention, ornaments 62 and 64 are connected by at least two ornamental connectors 70, a mounting hook 80, and a connector 90. According to one aspect of the invention, connectors 70, mounting hook 80, and connector 90, may be mounted to either side of ornaments 62 and 64. For example, in the aspect of the invention shown in FIGS. 6 and 7 (and in other Figures), connectors 70 are positioned on the front of ornaments 62 and 64. In another aspect of the invention, connectors 70 may be positioned on the back of ornaments 62 and 64. According to aspects of the present invention, ornaments 62 and 64, and all ornaments discussed herein, may comprise any type of perforated bead, stone, crystal, or the like that may be used in decorative fixtures. For example, according to one aspect of the invention ornaments 62 and 64, and any ornaments mentioned herein, may comprise any type of faceted or non-faceted (that is, smooth) shape, for example, spheres, cubes, cones, bars, tubes, rods, prisms, pears and the like. Ornaments 62 and 64, and any ornaments mentioned herein, may be made from glass, plastic, metal, stone, or any other conventional material from which ornamental beads and crystals are typically made. Ornaments 62 and 64, and any ornaments mentioned herein, may also comprise perforated gems or gems mounted on perforated mountings, for example, diamonds, rubies, sapphires, opals, and the like. Ornaments 62 and 64, and any ornaments mentioned herein, may be made from a transparent, translucent, or opaque material, for example, colored glass. In one aspect of the invention, ornaments 62 and 64, and any ornaments mentioned herein, may also comprise illuminated ornaments, such as, lights or light-emitting diodes (LEDs).

The details of connecting means 70 and its assembly into ornaments 62 are presented in FIGS. 8 through 23. The details of mounting hook 80 are presented in FIGS. 30 through 36. The details of connector 90 are presented in FIGS. 37 through 42.

Figure 8:
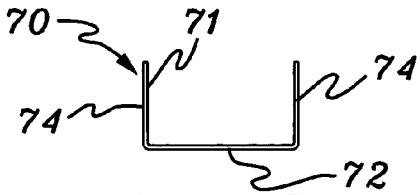
FIG. 8 is a plan view of an ornament connector according to one aspect of the present invention.

FIG. 8 is a side elevation view of an ornament connector 70 prior to assembly into ornaments 62 according to one aspect of the present invention. Connector 70 may comprise a wire 71, for example, a metallic wire that is first bent into the U-shape shown in FIG. 8. Though connector 70 is illustrated as a thin wire in the accompanying figures, this is for ease of illustration only. It will understood by those skilled in the art that connector 70 (and hook 80 and connector 90 discussed below), according to aspects of the invention, may be provided by various means and take various shapes. For example, connector 70 may be a fabricated part, for instance, connector 70 may be a stamped, a molded, an extruded, or a forged part, or a part fabricated by cutting from plate or sheet, for example, by laser cutting, water-jet cutting, or electro-discharge machining, among other methods. Connector 70 may be metallic and be made of iron, steel, stainless steel, aluminum, titanium, nickel, brass, bronze, copper, silver, or gold, among other metals. In one aspect of the invention, connector 70 is non-metallic, such as plastic. In one aspect of the invention, connector 70 may be made from a polyamide (PA), for example, nylon; polyethylene (PE), polypropylene (PP), polyester (PE), polytetraflouroethylene (PTFE), acrylonitrile butadiene styrene (ABS), a polycarbonate (PC); or a polyvinylchloride (PVC), among other plastics.

In one aspect of the invention, connector 70 may be made from any material that is formable, for example, formable to conform to the manipulations described below. Again, though connector 70 (and hook 80 and connector 90 discussed below) is illustrated as a circular wire, connector 70 may have a variety of cross-sectional shapes. For example, connector 70 (and hook 80 and connector 90) may have a cross-sectional shape that is circular, ellipsoidal, triangular, rectangular, square, or any other polygonal shape. According to one aspect of the invention, connector 70 may be made from coated or uncoated wire. For example, connector 70 may be made from about 0.010 inch wire to about 0.125 inch wire for example, wire having a diameter from about 0.020 inches to about 0.030 inches. In one aspect of the invention, connector 70 is made from nickel-chrome wire having a diameter of about 0.026 inches.

In the aspect shown in FIG. 8, connector 70 includes a spine 72 and two legs 74. Prior to assembly, legs 74 may project substantially perpendicular to the axis of spine 72 and be substantially parallel to each other. In another aspect of the invention, legs 74 may not be perpendicular to the axis of spine 72 and may not be parallel to each other, for example, depending upon the method of fabrication of connector 70 or the mode of assembly of connector 70 into ornaments 62. In one aspect of the invention, connector 70 may be cut from a source of wire and fashioned into a U-shape by hand. In another aspect of the invention, connector 70 may be cut from a source of wire and fashioned into a U shape mechanically, for example, by means of a manual or automated press or vise.

The dimensions of connector 70 will typically vary depending upon the size of the ornaments 62 connector 70 is used to connect. In one aspect of the invention, the length of spine 72 may be between about 6 mm and about 200 mm and is typically between about 15 mm and about 50 mm. In one aspect of the invention, the length of legs 74 may be between about 4 mm and about 80 mm inches and are typically between about 15 mm and about 50 mm, for example, in one aspect, the legs 74 are about 14 mm (0.625 inches) in length. In one aspect of the invention, legs 74 are of equal length; in another aspect of the invention, legs 74 may be of different length.

Figure 9:
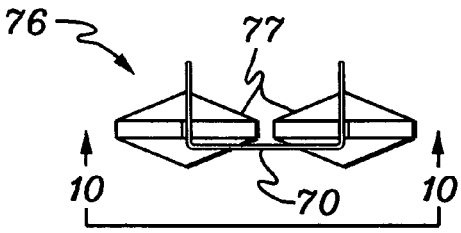
FIG. 9 is side elevation view of an assembly depicting the insertion of a first ornament connector shown in FIG. 8 into two ornaments according to one aspect of the present invention.
Figure 10:
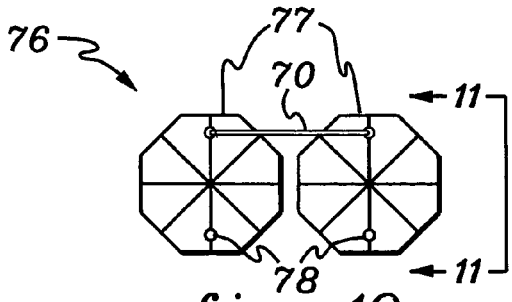
FIG. 10 is a front elevation view of the assembly shown in FIG. 9 as viewed along lines 10-10.

FIG. 9 is side elevation view of an assembly 76 depicting the insertion of a first ornament connector 70 shown in FIG. 8 into two ornaments 77 according to one aspect of the present invention. Ornaments 77 may be identical to each other or different from each other. Though in the aspect of the invention shown in FIGS. 9 through 23 ornaments 77 are shown as crystal octagons, ornaments 77 may be similar to ornaments 62 or 64 shown and described with respect to FIGS. 6 and 7. FIG. 10 is a front elevation view of the assembly 76 shown in FIG. 9 as viewed along lines 10-10. According to this aspect of the present invention, each ornament 77 typically includes at least two apertures, perforations, or through holes 78. According to one aspect of the invention, apertures or through holes 78 are directed substantially perpendicular to the plane of ornament 77; however, in one aspect of the invention, through holes 78 may not be perpendicular to the plane of ornament 77, but may make an angle, for example, an angle of at least about 5 degrees with the plane of ornament 77. Among other reasons, this non-perpendicular angle of through hole 78 may be provided to facilitate assembly of connector 70 into through hole 78. The insertion of connector 70 into through holes 78 of ornaments 77 may be practiced manually or by means of an automated device.

Figure 11:
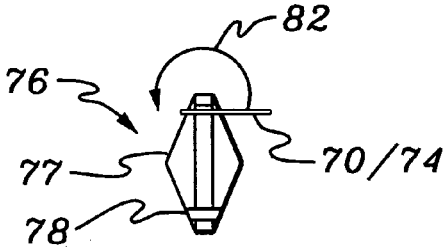
FIG. 11 is a side elevation of the assembly shown in FIG. 10 as viewed along lines 11-11 prior to the bending of the first connector.
Figure 12:
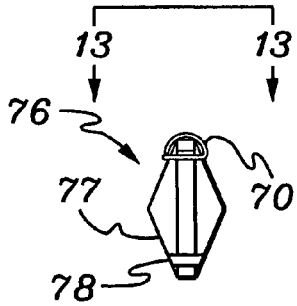
FIG. 12 is a side elevation view similar to the view shown in FIG. 11 after the bending of the first connector according to one aspect of the invention.
Figure 13:
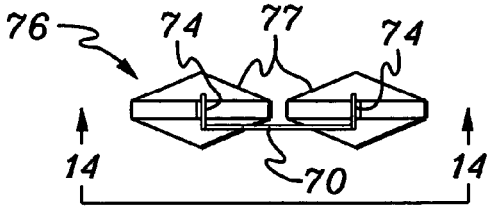
FIG. 13 is a side elevation view of the assembly of two ornaments as connected with the first connector as shown in FIG. 12 as viewed along lines 13-13.
Figure 14:
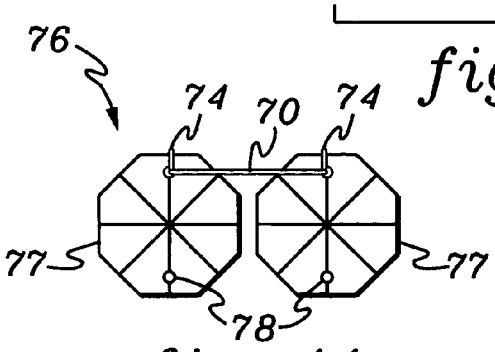
FIG. 14 is a front elevation view of the assembly shown in FIG. 13 as viewed along lines 14-14.

FIG. 11 is a side elevation view of the assembly 76 shown in FIG. 10 as viewed along lines 11-11 prior to the bending of the leg 74 of connector 70. According to this aspect of the invention, after insertion of legs 74 into the through holes 78 of adjacent ornaments 77, legs 74 are bent over the outer edge of ornament 77 as indicated by arrow 82 in FIG. 11. The bending of legs 74 about ornament 77 may be practiced manually or by automated means. The resulting orientation of bent leg 77 relative to ornament 77 is shown in FIG. 12. FIG. 12 is a side elevation view similar to the view shown in FIG. 11 after the bending of the leg 74 of connector 70. FIG. 13 is a side elevation view of two ornaments 77 as connected with one connector 70 shown in FIG. 12 as viewed along lines 13-13 in FIG. 12. FIG. 14 is a front elevation view of the assembly shown in FIG. 13 as viewed along lines 14-14.

According to one aspect of the invention, as shown in FIGS. 11 though 13, leg 74 of connector 70 may be bent in a direction substantially perpendicular to the axis of spine 72. For example, in one aspect of the invention leg 74 is bent to create a circular ring structure out of leg 74 that, for instance, more firmly engages leg 74 with ornament 77. In this aspect of the invention, the perpendicular bending of leg 74 minimizes or eliminates the potential for leg 74 to disengage from through hole 78, for example, under the heavier load of the weight of larger ornaments. In another aspect of the invention, leg 74 may be bent about through hole 78 in a direction that is non-perpendicular to the axis of spine 72. For example, in one aspect of the invention, leg 74 may be bent in a direction substantially parallel to the axis of spine 72, for example, as practiced using the prior art connector 40 shown in FIG. 5. One of skill in the art will recognize that other orientations of leg 74 relative to spine 72 may be provided and still reside in the scope of the present invention.

Figure 15:
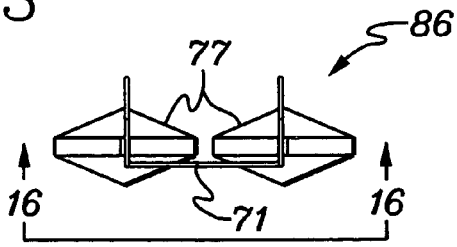
FIG. 15 is a side elevation view of an assembly depicting the insertion of a second ornament connector shown in FIG. 8 into two ornaments according to one aspect of the present invention.
Figure 16:
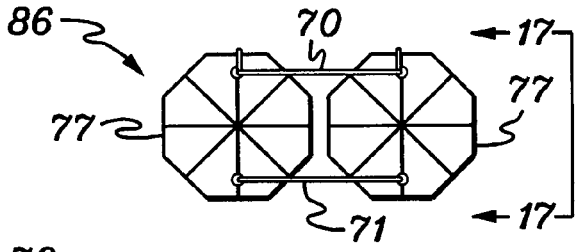
FIG. 16 is a front elevation view of the assembly shown in FIG. 15 as viewed along lines 16-16.
Figure 17:
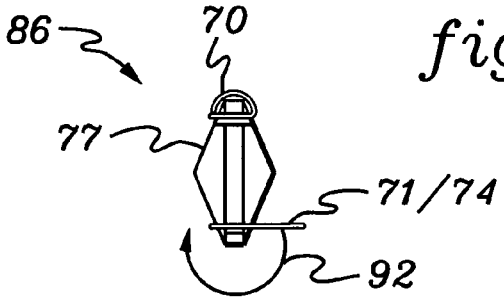
FIG. 17 is a side elevation of the assembly shown in FIG. 16 as viewed along lines 17-17 prior to the bending of the second connector according to one aspect of the invention.

FIG. 15 is a side elevation view of an assembly 86 depicting the insertion of a second connector 71 into two ornaments 77 shown in FIGS. 9 through 14 according to one aspect of the present invention. Connector 71 may be substantially identical to connector 70 shown in FIG. 8. FIG. 16 is a front elevation view of the assembly 86 shown in FIG. 15 as viewed along lines 16-16 in FIG. 15. Again, the insertion of connector 71 into through holes 78 of ornaments 77 may be practiced manually or by means of an automated device. FIG. 17 is a side elevation of the assembly 86 shown in FIG. 16 as viewed along lines 17-17 prior to the bending of the leg 74 of connector 71. According to this aspect of the invention, after insertion of legs 74 into the through holes 78 of adjacent ornaments 77, legs 74 of connector 71 are bent over the outer edge of ornament 77 as indicated by arrow 92 in FIG. 17 in a fashion similar to that described with respect to FIGS. 11 and 12. Again, the bending of legs 74 of connector 71 about ornament 77 may be practiced manually or by automated means. The resulting orientations of bent legs 74 of connectors 70 and 71 relative to ornament 77 are shown in FIG. 18.

Figure 18:
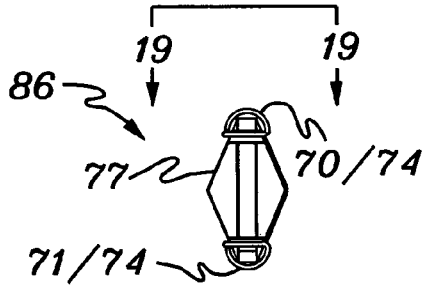
FIG. 18 is a side elevation view similar to the view shown in FIG. 17 after the bending of the second connector according to one aspect of the invention.
Figure 19:
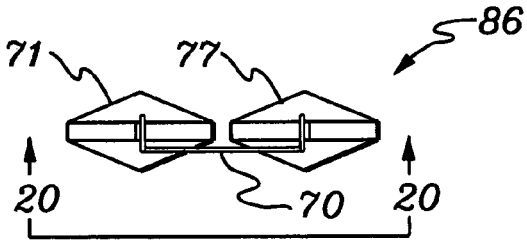
FIG. 19 is a side elevation view of the assembly of two ornaments as connected with two connectors as shown in FIG. 18 as viewed along lines 19-19.
Figure 20:
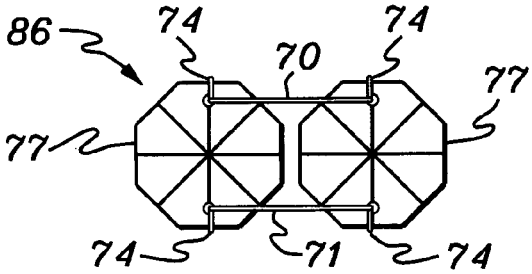
FIG. 20 is a front elevation view of the assembly shown in FIG. 19 as viewed along lines 20-20.

FIG. 18 is a side elevation view similar to the view shown in FIG. 17 after the bending of the leg 74 of connector 71. FIG. 19 is a side elevation view of two ornaments 77 as connected with connectors 70 and 71 shown in FIG. 18 as viewed along lines 19-19 in FIG. 18. FIG. 20 is a front elevation view of the assembly shown in FIG. 18 as viewed along lines 20-20. Again, according to one aspect of the invention, leg 74 of connector 71 may be bent in a direction substantially perpendicular to the axis of spine 72 or non-perpendicular to the axis of spine 72.

According to one aspect of the invention, the assembly 86 and assembly procedure illustrated and described with respect to FIGS. 9 through 20 may be repeated as often as necessary to assemble the desired length of ornament chain.

Figure 21:
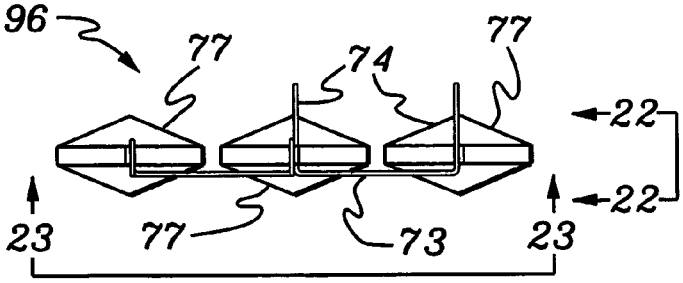
FIG. 21 is a side elevation view of an assembly depicting the insertion of a third ornament connector shown in FIG. 8 into a third ornament according to one aspect of the present invention.
Figure 22:
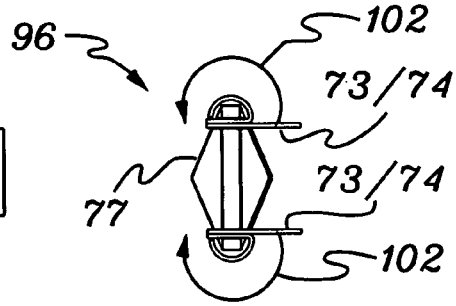
FIG. 22 is a side elevation view of the assembly shown in FIG. 21 as viewed along lines 22-22 prior to the bending of the third connectors according to one aspect of the invention.
Figure 23:
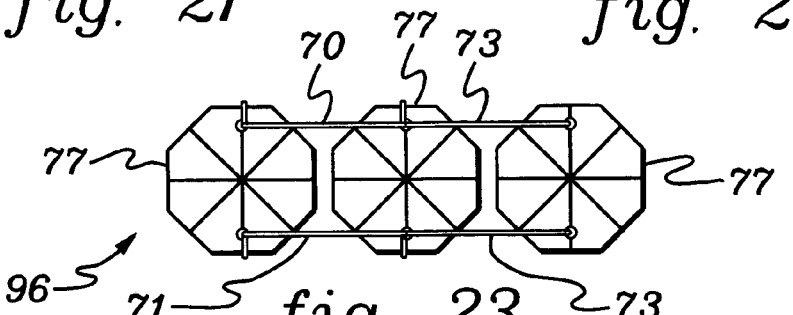
FIG. 23 is a front elevation view of the assembly shown in FIG. 21 as viewed along lines 23-23 after the bending of the third connectors according to one aspect of the invention.

FIG. 21 is a side elevation view of an assembly 96 depicting the insertion of a third ornament connector 73 into a third ornament 77 according to one aspect of the present invention. Connector 73 may be substantially identical to connector 70 shown in FIG. 8. Again, the insertion of connector 73 into through holes 78 of ornaments 77 may be practiced manually or by means of an automated device. Also, ornaments 77 may be similar or different from each other and may be similar to ornaments 62 and 64 described with respect to FIGS. 6 and 7. FIG. 22 is a side elevation view of the assembly 96 shown in FIG. 21 as viewed along lines 22-22 prior to the bending of the third connectors 73 according to one aspect of the invention. FIG. 23 is a front elevation view of the assembly 96 shown in FIG. 21 as viewed along lines 23-23 in FIG. 21 prior to the bending of the third connectors 73. According to this aspect of the invention, after insertion of legs 74 of connectors 73 into the through holes 78 of adjacent ornaments 77, legs 74 of connectors 73 are bent over the outer edge of ornament 77 as indicated by arrows 102 in FIG. 22. Again, the bending of legs 74 of connector 73 about ornament 77 may be practiced manually or by automated means. The resulting orientation of bent leg 74 of connector 73 relative to ornament 77 is substantially identical to the orientation shown in FIG. 18. The assembly procedure shown in FIGS. 21 through 23 may be repeated as often as desired to fabricate an ornament chain as long as desired.

Figure 25:
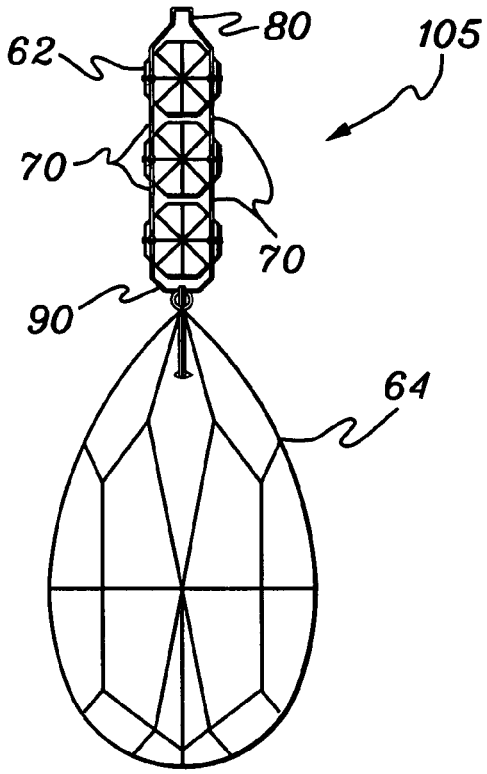
FIG. 25 is a front elevation view of the decorative ornament arrangement shown in FIG. 24 as viewed along lines 25-25.
Figure 24:
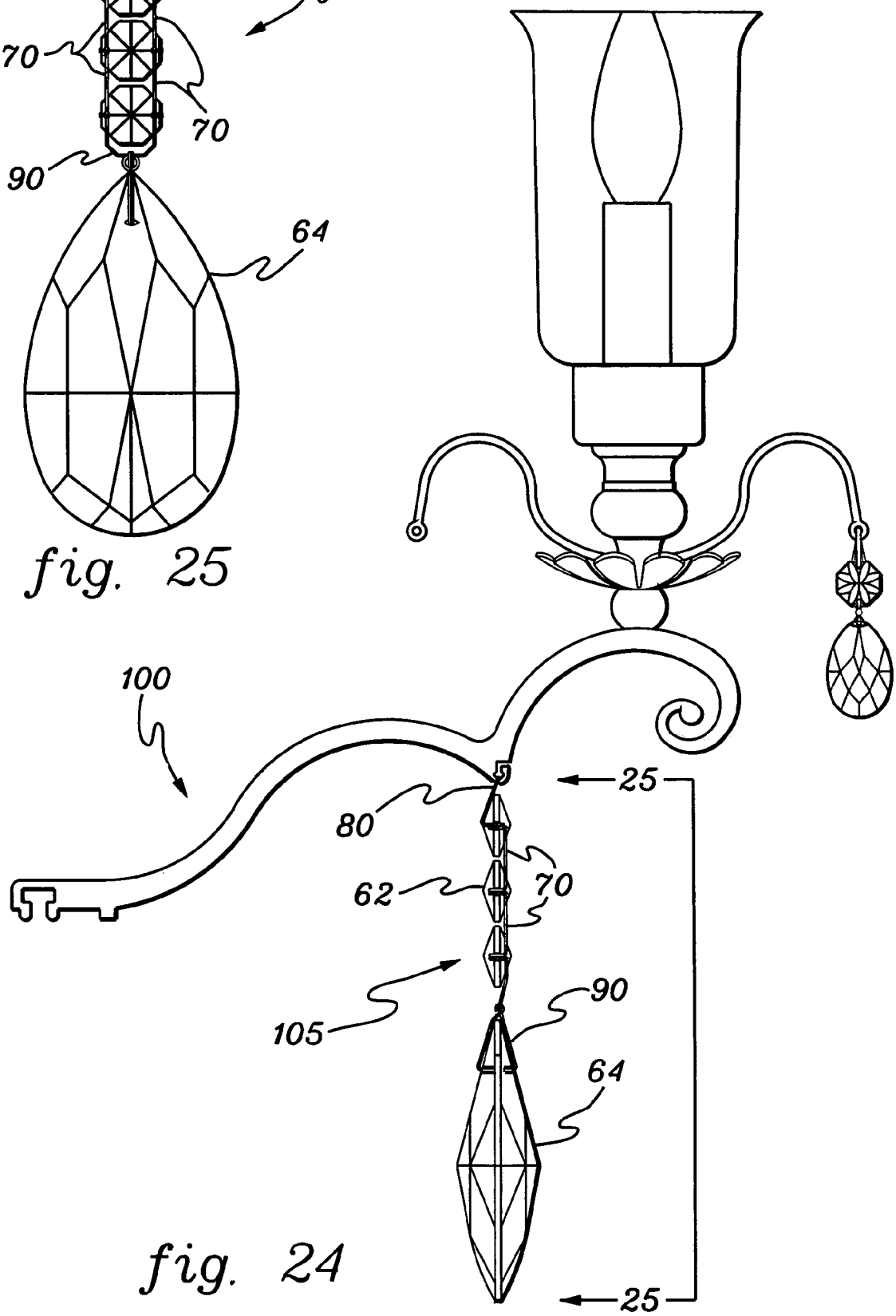
FIG. 24 is a side elevation view of a fixture mounting assembly having decorative ornaments mounted and connected according to one aspect of the present invention.

FIG. 24 is a side elevation view of a fixture mounting assembly 100 having decorative ornament arrangement 105 mounted and connected according to the aspects of the invention illustrated in FIGS. 9 through 23. FIG. 25 is a front elevation view of the decorative ornament arrangement 105 shown in FIG. 24 as viewed along lines 25-25. In one aspect of the invention, ornament arrangement 105 may be mounted to a fixture support by means of a carrying hook 80 as disclosed in the co-pending application referenced above under the heading "CROSS REFERENCE TO RELATED APPLICATIONS."

Figures 26, 27:
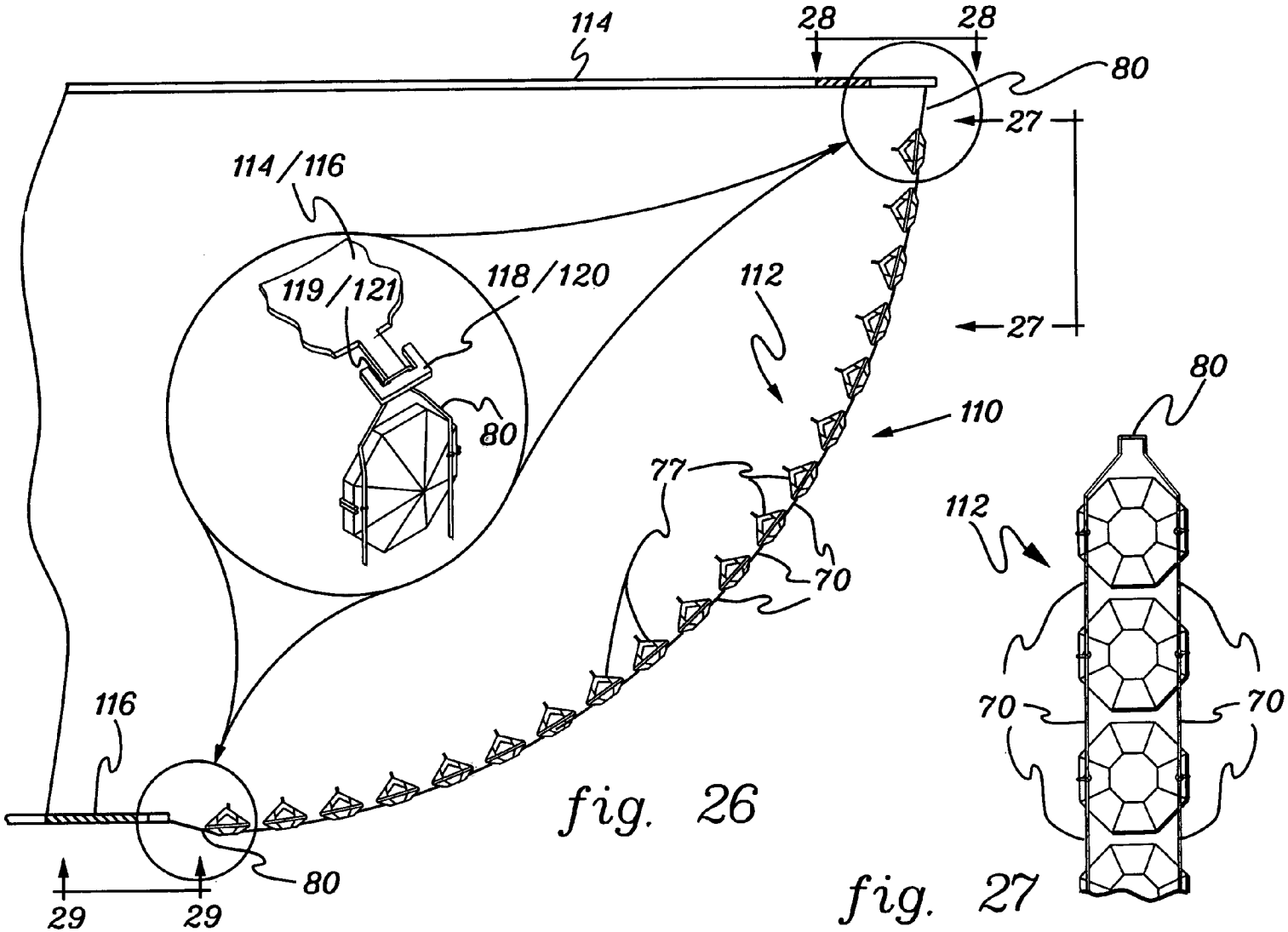
FIG. 26 is a side elevation view, partially in cross-section, of an ornament chain mounting having ornaments connected in a chain according to one aspect of the present invention.
FIG. 27 is a partial front elevation view of the decorative ornament chain shown in FIG. 26 as viewed along lines 27-27.

FIG. 26 is a side elevation view, partially in cross-section, of an ornament chain mounting 110 having ornaments 77 connected in a chain 112 according to one aspect of the present invention, for example, a chain assembled as shown in FIGS. 9 through 23. FIG. 26 is similar to the view of the prior art chain 54 shown in FIG. 3. FIG. 27 is a partial front elevation view of the decorative ornament chain 112 shown in FIG. 26 as viewed along lines 27-27.

Figure 28:
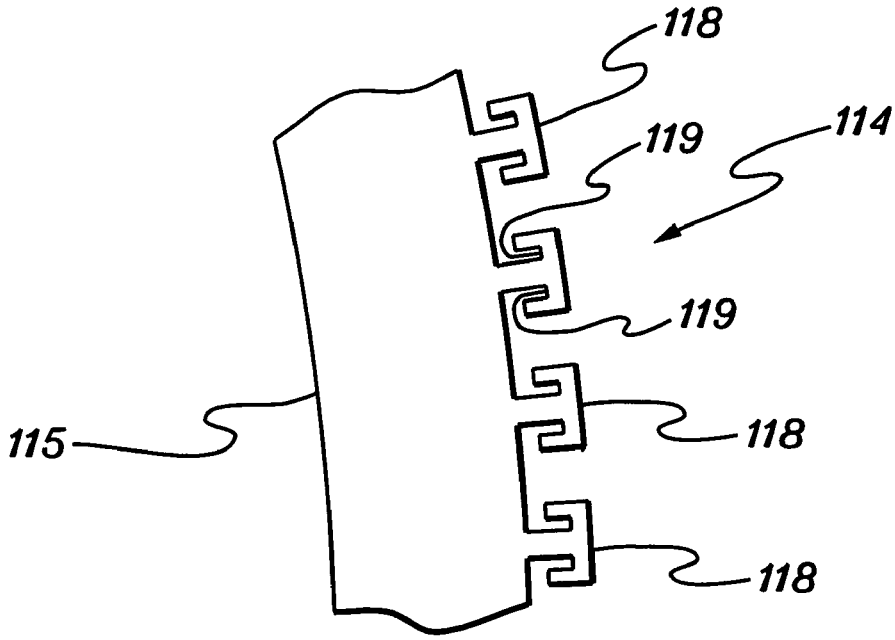
FIG. 28 is as partial plan view of the upper gallery ring shown in FIG. 26 according to one aspect of the present invention.
Figure 29:
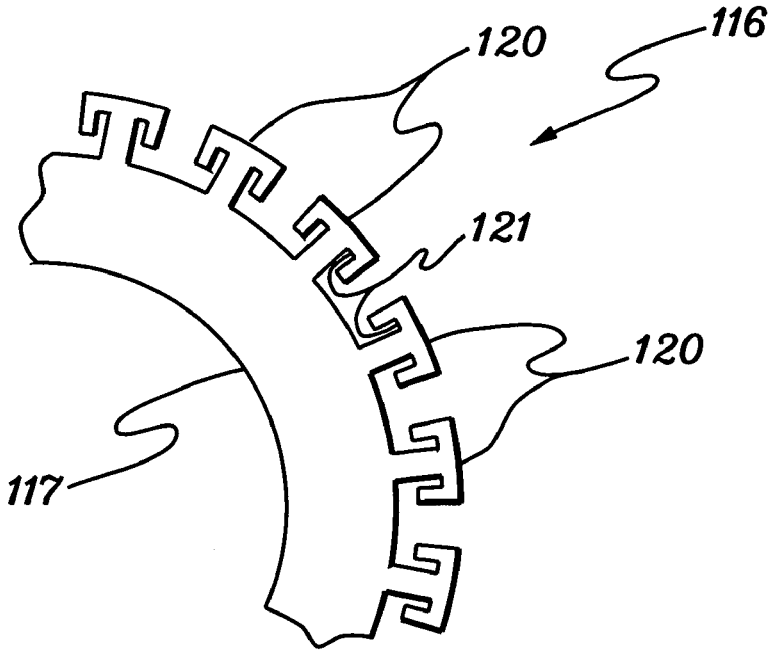
FIG. 29 is as partial plan view of the lower gallery ring shown in FIG. 26 according to one aspect of the present invention.

Chain mounting 110 includes ornaments 77 connected in series to provide a chain 112 using connectors 70 and hooks 80, described above. Mounting 110 may be one of a series of identical mountings used to form basket- or bowl-shaped arrangements for decorative fixtures, such as chandeliers. According to this aspect of the invention, chain 112 may be mounted to an upper support ring or gallery ring 114, which is partially shown in cross section, and a lower support ring or gallery ring 116, which is also partially shown in cross section. Partial plan views of gallery rings 114 and 116 according to aspects of the invention are shown in FIGS. 28 and 29. FIG. 28 is as partial plan view of the upper gallery ring 114 shown in FIG. 26 as viewed along lines 28-28. FIG. 29 is as partial plan view of the lower gallery ring 116 shown in FIG. 26 as viewed along lines 29-29.

FIGS. 28 and 29 illustrate only partial view of circular rings 114, 116 which may be solid or open, for example, having an internal diameter 115 and 117, respectively. According to aspects of the present invention, gallery rings 114 and 116 include a series of T-shaped projections or mounting brackets 118 and 120, respectively, on their outer diameters. T-shaped projections 118 and 120 may be adapted to engage and retain the loop of a hook, for example, the loop of hook 80 (discussed below). For example, in one aspect of the invention, projections 118 and 120 are adapted to support hook 80 as illustrated in the detail shown in FIG. 26. Projections 118 and 120 may be uniformly or non-uniformly distribute about the outer diameters of rings 114 and 116. For example, in one aspect of the invention projections 118 and 120 may be uniformly distributed about the outer diameters of rings 114 and 116 with a circumferential pitch (that is, circumferential spacing) of about 3 mm to about 2 feet, and are typically spaced at between about 15 mm and about 50 mm. According to one aspect of the invention, the loop of hook 80 engages cavities 119, 121 of projections 118, 120, respectively. Cavities 119 and 121 may have a length of between about 0.625 inches and about 0.25 inches and a width of between about 0.031 inches and about 0.25 inches (depending upon the diameter of the connector inserted in the cavities). The size and thickness of gallery rings 114 and 116 will vary depending upon the size and load of the fixture in which they are used. In one aspect of the invention, the outside diameter of gallery rings 114 and 116 may vary from about 6 inches to about 20 feet. In one aspect of the invention, the thickness of gallery rings 114 and 116 may vary from about 0.020 inches to about 1 inch. Gallery rings 114 and 116 may be metallic or non-metallic, for example, made from one or more of the metals or plastics mentioned above with respect to connector 70. In an aspect of the invention, brackets 118 and 120 may be provided on a non-circular plate, for example, a curved plate or a straight plate, for instance, to provide an arrangement of ornament mountings which display a "curtain" effect.

Figure 30:
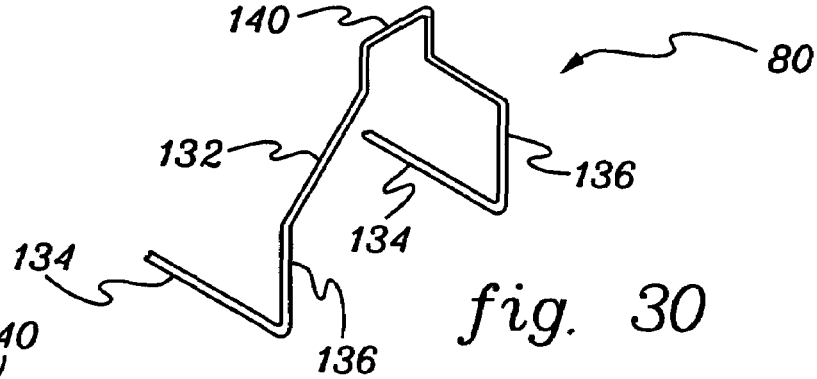
FIG. 30 is a perspective view of the mounting hook shown in FIG. 26 according to one aspect of the invention.

FIG. 30 is a perspective view of the mounting hook 80 shown in FIG. 26 according to another aspect of the invention. Mounting hook 80 may sometimes be referred to as a "Y hook." According to one aspect of the invention, when mounting hook 80 is used with an ornament chain assembled using connectors 70, for example, ornament chain 110 shown in FIG. 26, the ornaments in the ornament chain are oriented in a preferred orientation, for example, directed radially outward or radially inward in a chandelier. In addition, mounting hook 80 typically minimizes or eliminates the tendency for an ornament chain to twist or pivot, as is typical with connecting hooks of the prior art. Moreover, having two connection points, mounting hook 80 can also withstand a larger loading than conventional connecting hooks.

Figure 31:
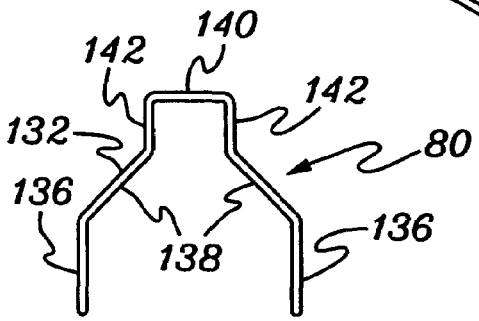
FIG. 31 is front elevation view of the mounting hook shown in FIG. 30.
Figure 32:
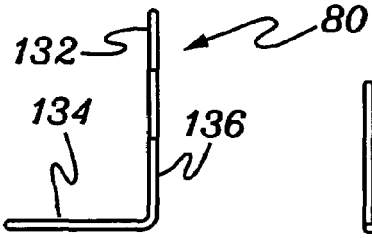
FIG. 32 is left side elevation view of the mounting hook shown in FIG. 30, the right side elevation view being a mirror image thereof.
Figure 33:
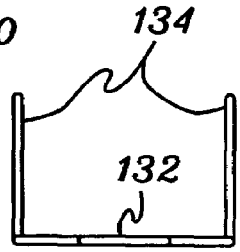
FIG. 33 is top view of the mounting hook shown in FIG. 30.

Similar to connector 70, mounting hook 80 may comprise coated or uncoated wire bent into the shape shown or may be fashioned from sheet, plate, or strip, for example, by cutting or stamping. Mounting hook 80 may be metallic, for example, stainless steel, gold, or any one of the metals mentioned above with respect to connector 70, or non-metallic, such as plastic. FIG. 31 is front elevation view of mounting hook 80 shown in FIG. 30. FIG. 32 is left side elevation view of mounting hook 80 shown in FIG. 30, the right side elevation view being a mirror image thereof. FIG. 33 is top view of mounting hook 80 shown in FIG. 30. Connector 80 is typically made from about 0.010 inch wire to about 0.125 inch wire for example, wire having a diameter from about 0.020 inches to about 0.030 inches. In one aspect of the invention, connector 80 is made from nickel-chrome wire having a diameter of about 0.026 inches.

Connector 80 includes a spine 132 and two legs 134. In the aspect of the invention shown in FIG. 30, prior to assembly, legs 134 may project substantially perpendicular to the axis of spine 132 (for example, the axis of spine 132 as viewed in FIG. 33) and be substantially parallel to each other. In another aspect of the invention, legs 134 may not be perpendicular to the axis of spine 132 and may not be parallel to each other, depending upon the method of fabrication of mounting hook 80 or the mode of assembly of mounting hook 80 into ornaments, for example, ornaments 62 or 77 discussed above.

In the aspect of the invention shown in FIGS. 30 through 33, spine 132 of mounting hook 80 may include uprights 136, slanted sections 138, and loop section 140 having legs 142. Uprights 136 may typically be bent perpendicular to legs 134 and slanted sections 138 may be bent at an angle from uprights 136. The angle of slanted sections 138 from the direction of uprights 136 may vary from about 30 degrees to about 60 degrees and is typically about 45 degrees. Loop section 140 is adapted to engage gallery rings, for example, gallery rings 114 and 116 shown in FIGS. 26, 28, and 29. According to one aspect of the invention, legs 142 of hook section 140 engage slots in gallery rings, for example, slots 119 in gallery ring 114 shown in FIG. 28, or slots 121 in gallery ring 116 shown in FIG. 29. In one aspect of the invention, loop section 140 of mounting hook 80 may also be adapted to engage one or more of the ornament mounting hook arrangements shown in FIGS. 43 through 52. The length and width of connector 80, for example, the length of legs 134 and width of hook section 140, may vary depending upon the size and weight of the ornaments mounted on mounting hook 80. For example, in one aspect of the invention, the length of legs 134 of mounting hook 80 may be between about 4 mm and about 80 mm inches; the width of spine 132 of mounting hook 80 may be between about 15 mm and about 60 mm; the height of mounting ring 80 may be between about 4 mm and about 80 mm, for example, about 0.625 inches. In one aspect of the invention, legs 134 are of equal length; in another aspect of the invention, legs 134 may be of different lengths.

In one aspect of the invention, mounting hook 80 may be cut from a source of wire and fashioned into a U-shape shown by hand. In another aspect of the invention, mounting hook 80 may be cut from a source of wire and fashioned into a U shape mechanically, for example, by means of a manual or automated press or vise. In another aspect of the invention, mounting hook 80 may be a fabricated part, for example, mounting hook 80 may be a stamped, a molded, or a forged part, or a part fabricated by cutting from plate or sheet, for example, by laser cutting, water-jet cutting, or electro-discharge machining, among other methods.

Figure 34:
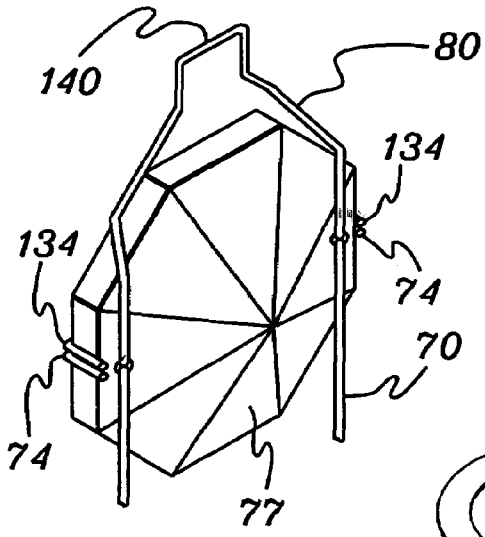
FIG. 34 is a perspective view of an assembly of the mounting hook shown in FIG. 30 onto an ornament according to one aspect of the invention.

FIG. 34 is a perspective view of an assembly of mounting hook 80 shown in FIGS. 30 through 33 and connector 70 shown in FIG. 8 onto an ornament 77 according to one aspect of the invention. Mounting hook 80 may be inserted into apertures in ornament 77 and legs 134 may be bent around ornament 77 in a fashion similar to the method of mounting connector 70 onto ornament 77, as shown in FIGS. 9 through 20.

Figure 35:
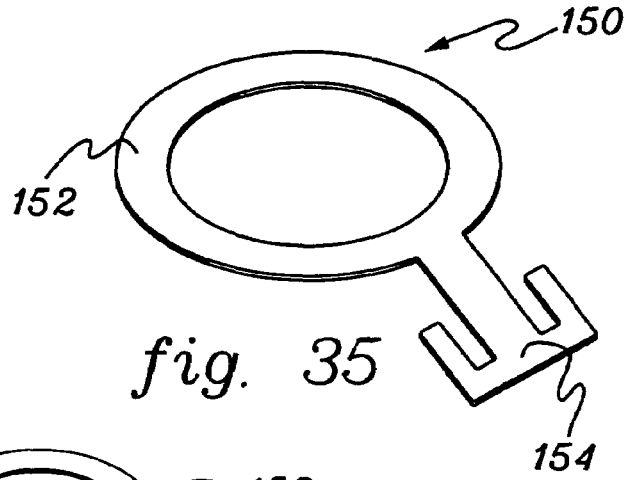
FIG. 35 is a perspective view of a mounting ring having a mounting bracket to which the mounting hook shown in FIG. 30 can be mounted according to one aspect of the invention.
Figure 36:
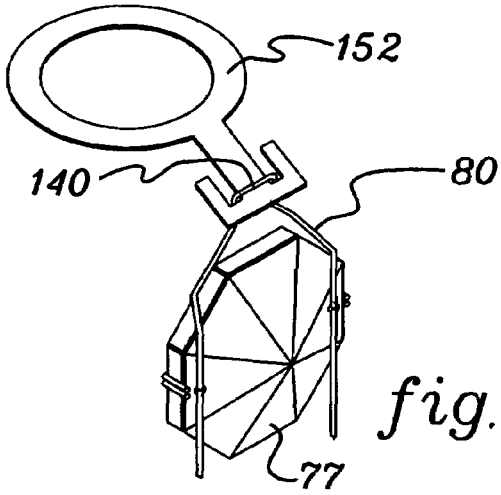
FIG. 36 is a perspective view of the assembly of the mounting hook assembly shown in FIG. 35 on the mounting ring shown in FIG. 36.

FIG. 35 is a perspective view of a mounting ring 150 according to another aspect of the present invention. Mounting ring 150 typically includes a ring 152 having one or more projections or mounting brackets 154. Mounting brackets 154 may be similar to T-shaped projections 118 and 120 of gallery rings 114 and 116 shown in FIGS. 28 and 29, respectively. Mounting ring 150 may be used in various locations upon a fixture or chandelier. For example, mounting ring 150 may be mounted beneath a fixture 12 shown in FIG. 1 to provide a means for mounting one or more ornament arrangements, for example, arrangement 60 shown in FIGS. 6 and 7, to the fixture shown in FIG. 1. Mounting ring 150 may be made from one or more of the metallic or non-metallic materials listed above with respect to connector 70. Though the size of mounting ring 150 may vary broadly depending upon the loading, the thickness of mounting ring 152 may vary from about 0.03125 inches to about 0.5 inches, and is typically between about same 0.031 inches and about 0.063 inches. Similarly, the outside diameter of mounting ring 152 may vary from about 0.25 inches to about 6 inches, and is typically between about 0.75 inches and about 1.0 inch. In addition, as shown in FIGS. 35 and 26, mounting bracket 154 may make an angle between about 5 and 75 degrees with the plane of ring 152. For example, in one aspect of the invention, mounting bracket 154 makes an angle between about 15 and 60 degrees with the plane of ring 153. A perspective of a typical mounting of mounting hook 80 on mounting ring 150 is shown in FIG. 36. In another aspect of the invention, mounting hook 80 may be mounted to one or more of the hook arrangements shown in FIGS. 43 through 48 discussed below.

Figure 38:
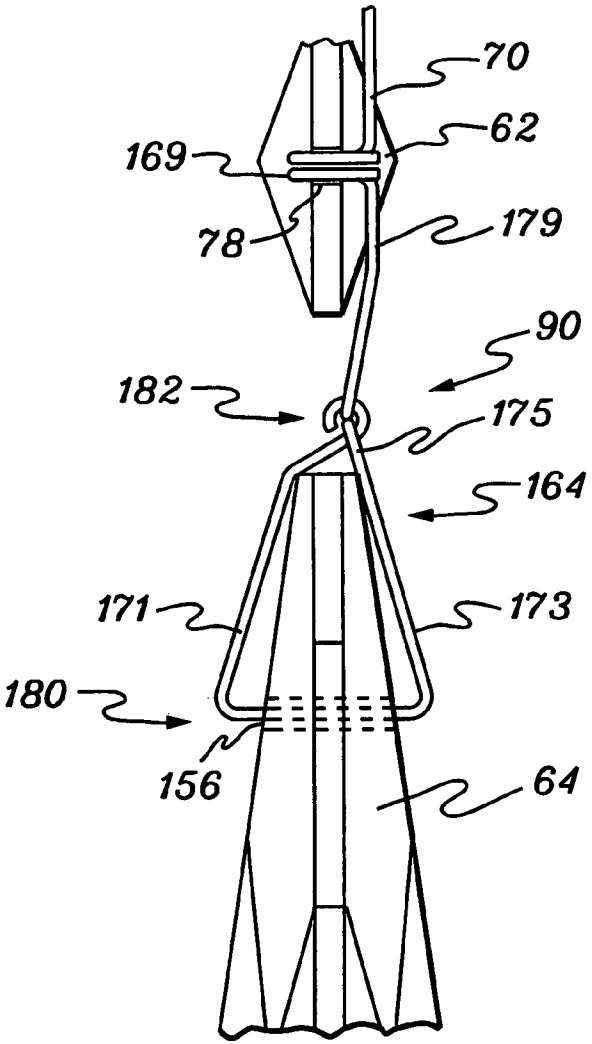
FIG. 38 is a side elevation view of the connector assembly shown in FIG. 37 as viewed along lines 38-38.
Figure 37:
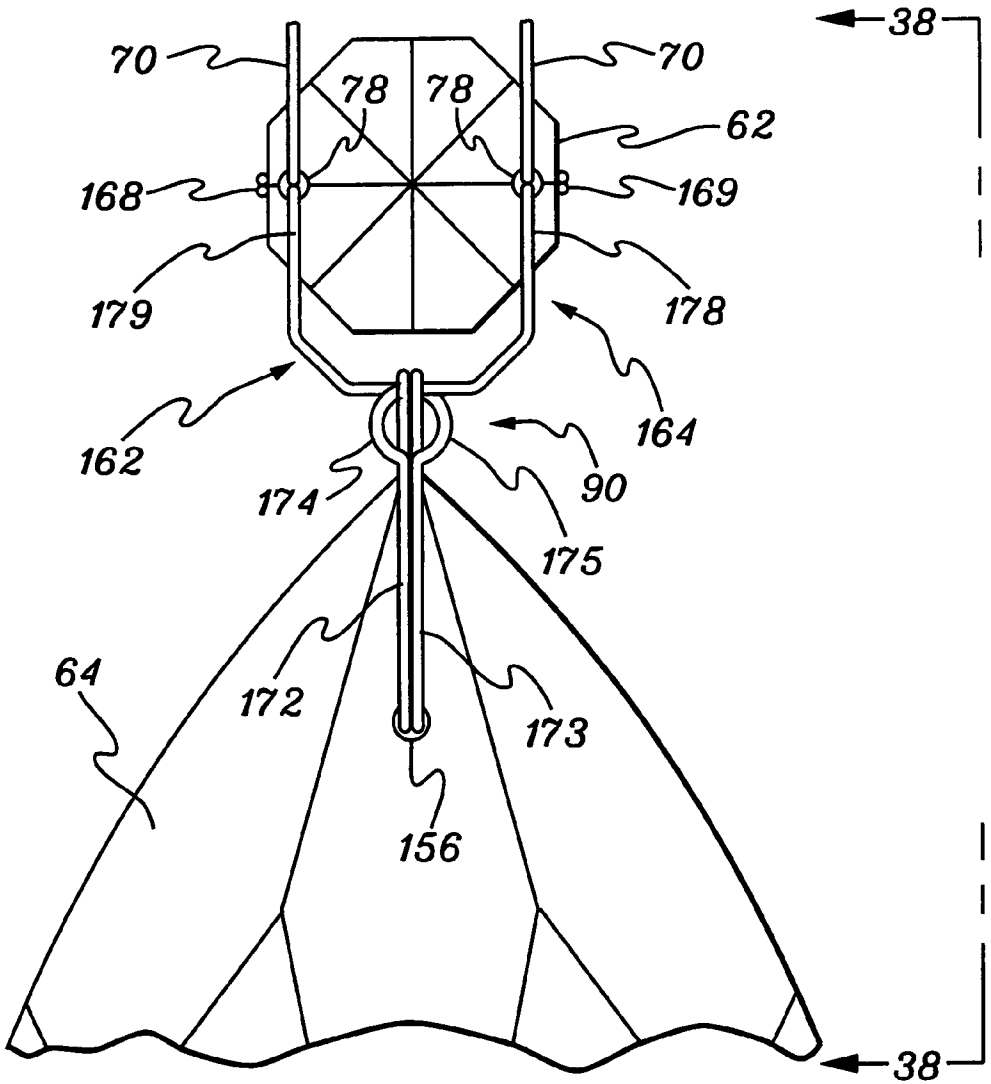
FIG. 37 is a detailed plan view of the connector assembly shown in FIGS. 24 and 25.

A detailed plan view of the assembly of connector 90 shown in FIGS. 24 and 25 is shown in FIG. 37. A side elevation view of connector 90 as viewed along lines 38-38 of FIG. 37 is shown in FIG. 38. As shown in FIGS. 37 and 38, according to one aspect of the invention, connector 90 may be used to mount an ornament 64 having one or more apertures, perforations, or through holes 156 to an ornament 62 having at least two perforations or through holes 78. Connector 90 may be made from sub-connectors 162 and 164. Detailed views of connector 90 and sub-connectors 162 and 164 are shown in FIGS. 39 through 42.

Figure 39:
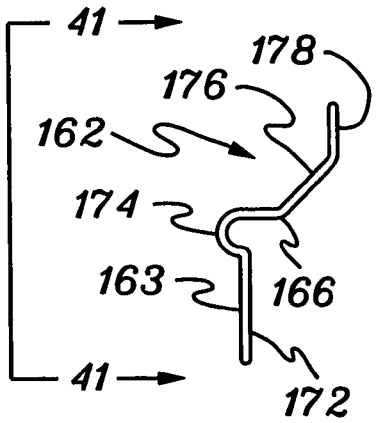
FIG. 39 is an elevation view of a sub-connector shown in FIGS. 37 and 38.
Figure 40:
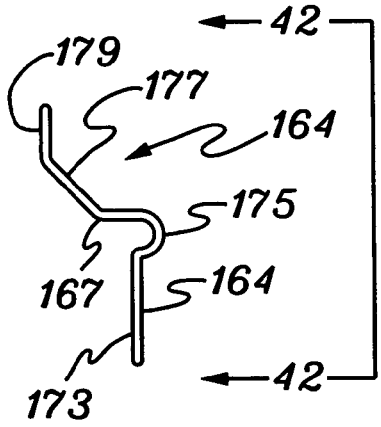
FIG. 40 is an elevation view of another sub-connector shown in FIGS. 37 and 38.
Figure 41:
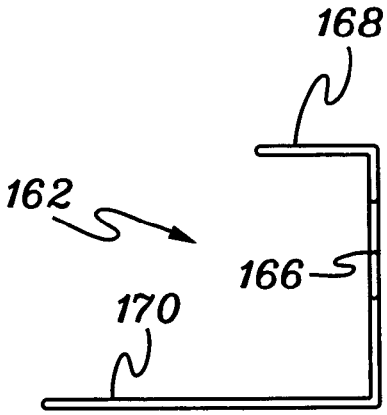
FIG. 41 is a left-side view of the sub-connector shown in FIG. 39.
Figure 42:
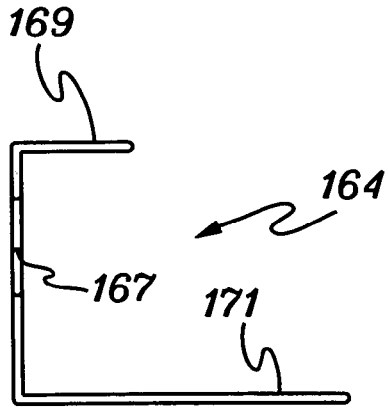
FIG. 42 is a right-side view of the sub-connector shown in FIG. 40.

FIG. 39 is a front elevation view of sub-connector 162 of connector 90 according to one aspect of the invention. FIG. 40 is a front elevation view of sub-connector 164 of connector 90 according to one aspect of the invention. Sub-connectors 162 and 164 are assembled as shown in FIGS. 37 and 38 to provide the desired connector 90. FIG. 41 is a left side elevation view of sub-connector 162 as viewed along lines 41-41 in FIG. 39. FIG. 42 is a right side elevation view of sub-connector 164 as viewed along lines 42-42 in FIG. 39.

Similar to connector 70 and mounting hook 80, connector 90 may comprise coated or uncoated wire bent into the shapes shown, or fabricated as described above with respect to connector 70 and mounting hook 80. Connector 90 may be metallic, for example, made from stainless steel, gold, or any one of the metals mentioned above with respect to connector 70, or non-metallic, such as plastic. Sub-connectors 162, 164 are typically made from 0.010 inch wire to about 0.125 inch wire for example, wire having a diameter from about 0.020 inches to about 0.030 inches. In one aspect of the invention, sub-connectors 162 and 164 are made from nickel-chrome wire having a diameter of about 0.026 inches.

Sub-connector 162 includes a spine 166 and two legs 168, 170. Sub-connector 164 includes a spine 167 and two legs 169, 171. In the aspect of the invention shown in FIG. 30, prior to assembly, legs 168 and 170 and legs 169 and 171 may project substantially perpendicular to the axis of spines 166 and 167, respectively, (for example, as shown in FIGS. 41 and 42, respectively) and the legs may be substantially parallel to each other. In another aspect of the invention, legs 168 and 170 and legs 169 and 171 may not be perpendicular to the axis of spines 166 and 167 and may not be parallel to each other, depending upon the method of fabrication of mounting hook 90 or the mode of assembly of mounting hook 90 into ornaments, for example, ornaments 62 or 77 discussed above.

In the aspect of the invention shown in FIGS. 39 through 42, spines 166, 167 of sub-connectors 162 and 164, respectively, may include lower sections 172, 173; loop sections 174, 175; slanted sections 176, 177; and upper sections 178, 179, respectively. Lower sections 172, 173 may typically be bent perpendicular to legs 170, 171, respectively. Slanted sections 176, 177 may be bent at an angle from lower sections 172, 173, respectively. The angle of slanted sections 176, 177 from the direction of lower sections 172, 173 may vary from about 30 degrees to about 60 degrees and are typically bent about 45 degrees. Upper sections 178, 179 may be substantially parallel to lower sections 172, 173, respectively.

The length and width of connector 90, for example, the length of legs 168, 169, 170, and 171 and the height of spines 166, 167 may vary depending upon the size and weight of the ornaments mounted on connector 90. For example, in one aspect of the invention, the length of legs 168, 169, 170, and 171 of connector 90 may be between about 0.375 inches and about 2.0 inches; the height of spines 166, 167 may be between about 1.25 inches and about 1.75 inches; the inside diameter of loop sections 174, 175 may be between about 0.125 inches and about 0.25 inches. In one aspect of the invention, legs 168 and 169 are of about equal length; in another aspect of the invention, legs 168 and 169 may be of different lengths. In one aspect of the invention, legs 170 and 171 are of about equal length; in another aspect of the invention, legs 170, 171 may be of different lengths.

In one aspect of the invention, sub-connectors 162 and 164 of connector 90 may be cut from a source of wire and fashioned into the shapes shown by hand. In another aspect of the invention, sub-connectors 162 and 164 may be cut from a source of wire and fashioned into the shapes shown mechanically, for example, by means of a manual or automated press or vise.

The assembly of sub-connectors 162 and 164 into ornaments 62 and 64 to create connector 90 is best illustrated in FIGS. 37 and 38. First, with reference to FIG. 38, leg 170 of sub-connector 162 and leg 171 of sub-connector 164 are inserted though hole 156 in ornament 64 and bent as indicated at 180 in FIG. 38 and directed along the opposite side of ornament 64. Legs 170 and 171 are then inserted though the hoop defined by loop sections 174 and 175 and curled around loop sections 174 and 175 as indicated at 182 of FIG. 38 to secure the ends of legs 170 and 171 to loop sections 174 and 175. This engages sub-connectors 162 and 164 to ornament 64.

Next, leg 168 of sub-connector 162 and leg 169 of sub-connector 164 are inserted into respective holes 78 in ornament 62. In a fashion similar to the method illustrated in FIGS. 9 through 20, legs 168 and 169 are bent about ornament 62, for example, at a right angle to the upper sections 178, 179, respectively, to secure sub-connectors 162 and 164 to ornament 62. According to aspects of the present invention, connector 90 then provides a secure connection between ornament 64 and ornament 62.

Figure 43:
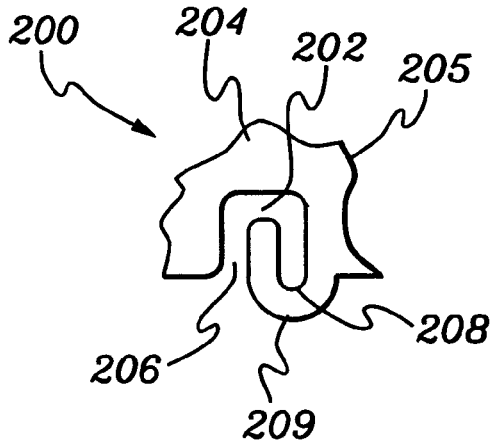
FIG. 43 is a plan view of a hook arrangement for mounting ornaments according to another aspect of the invention.

In another aspect of the invention, mounting hook 80 illustrated and described with respect to FIGS. 30 through 36 may be mounted to one or more of the ornament mounting hook arrangements shown in FIGS. 43 through 52. FIG. 43 is a plan view of an ornament mounting hook arrangement, or "crystal-carrying cut-out," 200 for mounting ornaments, for example, using mounting hook 80, according to another aspect of the invention. Mounting hook arrangement 200 includes a passage 202 in a sheet or plate 204. Sheet or plate 204 may be made from one or more of the metallic or non-metallic materials discussed above with respect to connector 70. In the aspect of the invention shown in FIG. 43, plate 204 is shown with a representative course edge 205 indicating that the size of the plate 204 that may be used in implementing mounting hook arrangement 200 may vary broadly, some examples of which will be illustrated below.

Figure 44:
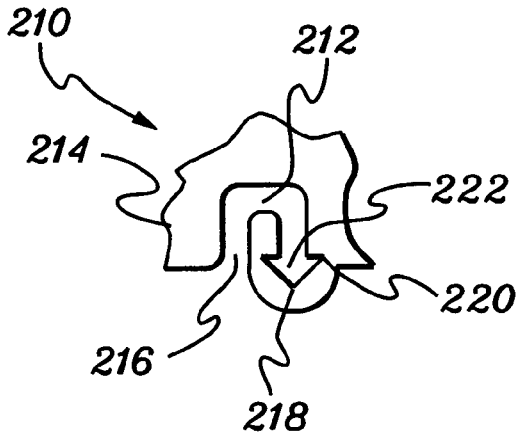
FIG. 44 is a plan view similar to FIG. 43 of another hook arrangement according to the present invention.

According to this aspect of the invention, passage 202 comprises an inverted, U-shaped passageway having an open end 206 and a closed end 208. Open end 206 may be flared or beveled to assist in permitting the passage of a connector into passage 202. Closed end 208 may be radiused, as shown, or include radiused or square corners, or come to a point (as shown in FIG. 44). According to this aspect of the invention, an ornament mounting hook, such as mounting hook 80, may be attached to arrangement 200 by passing the ornament mounting hook into open end 206, through passage 202 and onto closed end 208. Ornament mounting hook arrangement 200 may include a protrusion 209 beyond the surface of plate 204. Protrusion 209 may be provided to allow the location of closed end 208 to be properly positioned, for example, low enough, to avoid interference between mounting arrangement 200 and the connector or hook, such as hook 80, mounted in mounting arrangement 200. Protrusion 209 may be circular as shown in FIG. 43 or triangular, rectangular, or oval, among other shapes, as desired by the design of the fixture in which mounting arrangement 200 is used.

FIG. 44 is a plan view similar to FIG. 43 of another ornament mounting hook arrangement 210 according to the present invention. Similar to mounting hook arrangement 200, mounting hook arrangement 210 includes a passage 212 in a sheet or plate 214, the passage having an open end 216 and a closed end 218. According to this aspect of the invention, closed end 218 of passage 212 may converge to a point. According to this aspect of the invention, the use of a pointed closed end 218 allows the fixture designer to more precisely locate ornaments mounted on, for example, hooks such as hooks 80. For instance, the loop of hook 80 settles into the point of closed end 218 and the location of hook 80 is less likely to vary from the location defined by the pointed closed end 208.

According to another aspect of the invention, passage 212 may also include an abrupt enlargement in width, for example, as indicated at 220 in FIG. 44. This enlargement 220 creates a cavity 222 into which an ornament connector, such as connector 80, can be retained. For example, in one aspect of the invention, enlargement 220 provides an obstruction to the disengagement of a connector inserted into cavity 222 which minimizes or prevents a connector from dislodging from ornament mounting hook arrangement 210. In the aspect of the invention shown in FIG. 44, pointed end 218 and enlargement 220 create an arrow-point like structure for cavity 222. However, depending upon the shape of closed end 218 and enlargement 220, the shape of cavity 222 may take any appropriate form, including circular, rectangular, or oval, among others.

Figure 45:
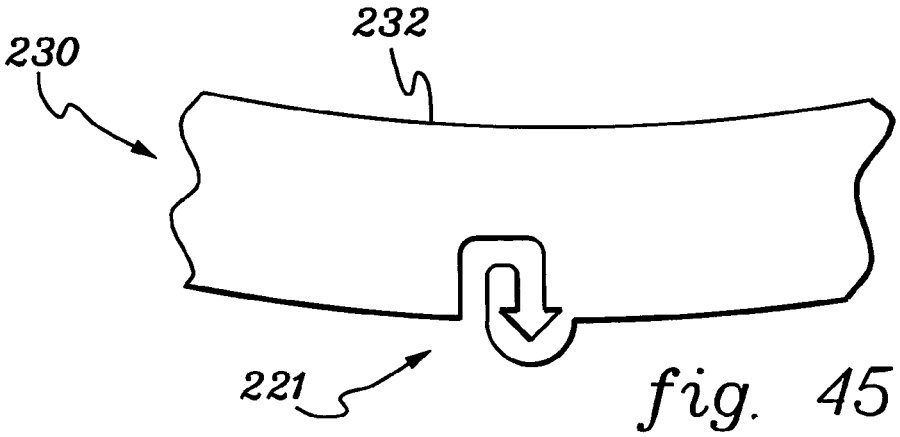
FIG. 45 is a plan view the hook arrangement shown in FIG. 44 when provided in a plate-type fixture.
Figure 46:
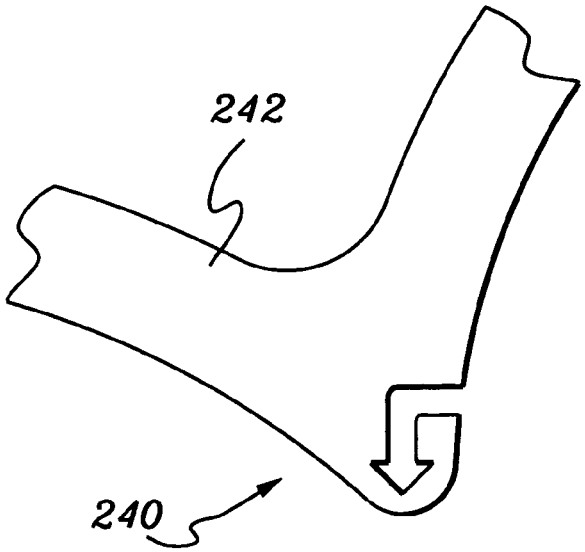
FIG. 46 is a plan view of another hook arrangement according to the present invention.
Figure 47:
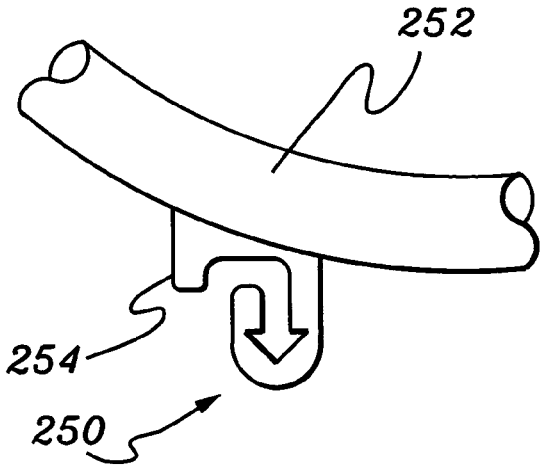
FIG. 47 is a plan view of another hook arrangement according to the present invention when provided for a tubular arm.

FIG. 45 is a plan view of one aspect of the invention 230 in which ornament mounting hook arrangement 210 shown in FIG. 44 is provided in a plate-type arm 232 of an ornamental fixture. FIG. 46 is a plan view of another hook ornament mounting hook arrangement 240, similar to ornament mounting hook arrangement 210 shown in FIG. 45 as provided in a plate-like arm 242 according to another aspect of the present invention. In this aspect of the invention, the open end of the passage is positioned in a vertical edge of the arm 242. FIG. 47 is a plan view of another ornament mounting hook arrangement 250 according to the present invention when provided for a circular arm 252. Arm 252 may be hollow or solid, metallic or non-metallic, such as glass. According to this aspect of the invention, the ornament mounting hook arrangement 200 and 210 shown in FIGS. 43 and 44 is provided in a plate-like bracket 254 mounted to arm 252. Bracket 254 may be mounted to arm 252 by means of mechanical fasteners, welding, brazing, or adhesives, among other conventional means. According to one aspect of the invention bracket 254 may be made from the same or a different material from the material from which arm 252 is made, for example, one or more of the metallic or non-metallic materials discussed above with respect to connector 70. In one aspect of the invention, plate 252 and arm 254 may be fabricated as a single integral part, for example, by casting or forging.

Figure 48:
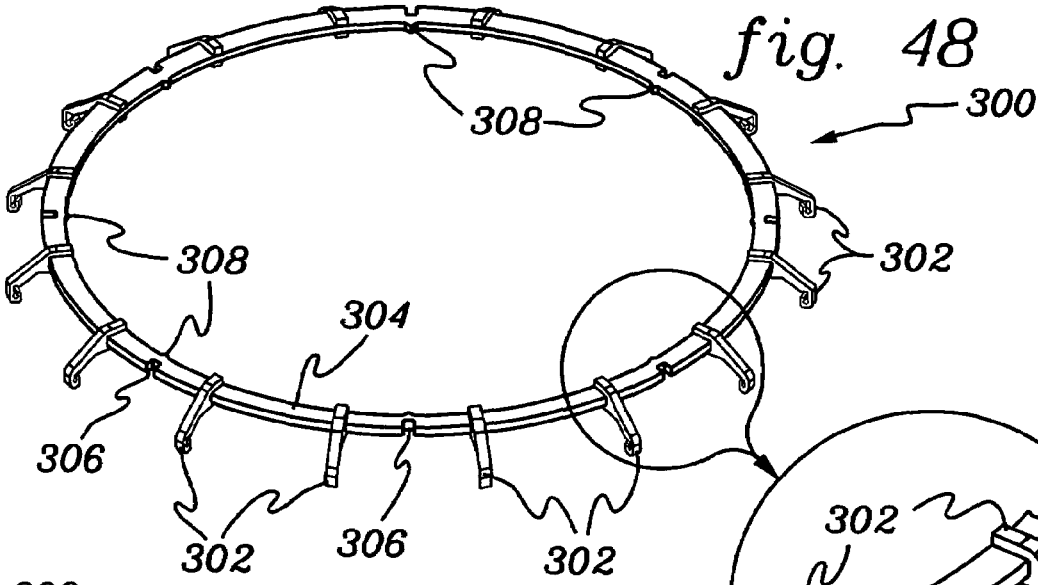
FIG. 48 is a perspective view of another aspect of the invention providing the hook arrangement of FIG. 44.
Figure 51:
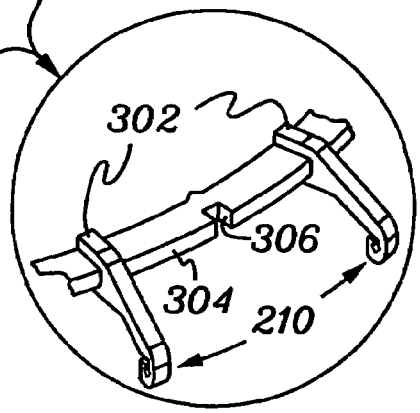
FIG. 51 is a detailed perspective view of the hook arrangement shown in FIG. 48.
Figure 49:
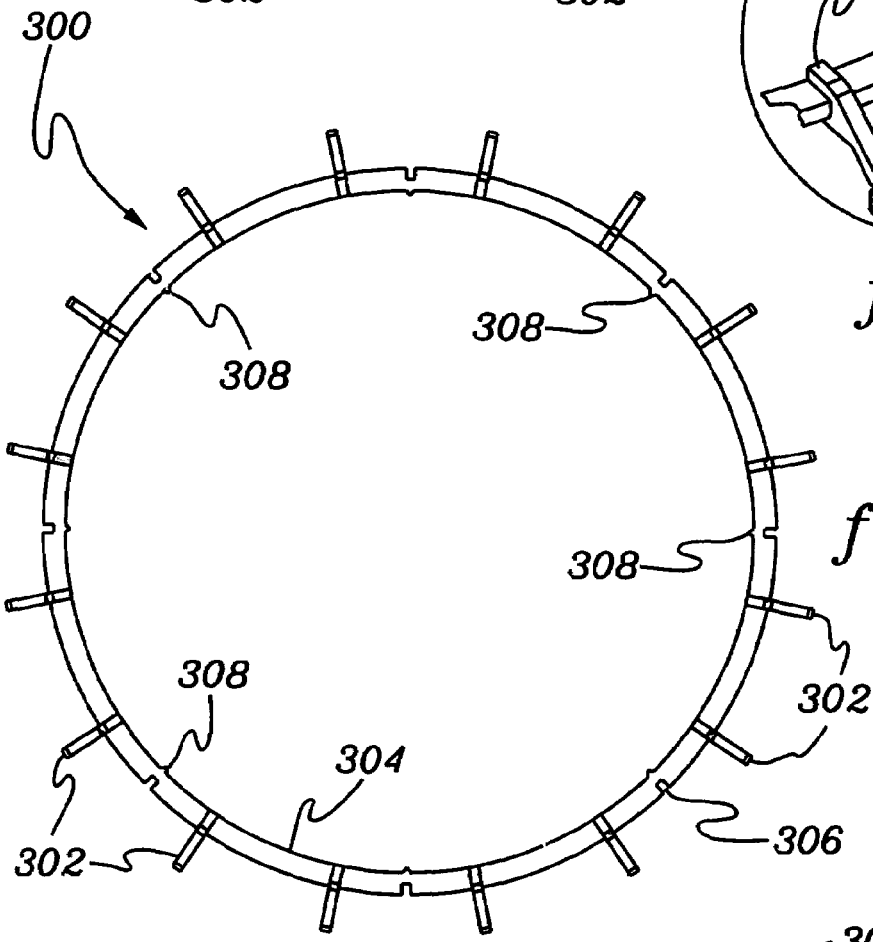
FIG. 49 is a plan view of the aspect of the invention shown in FIG. 48.
Figure 50:
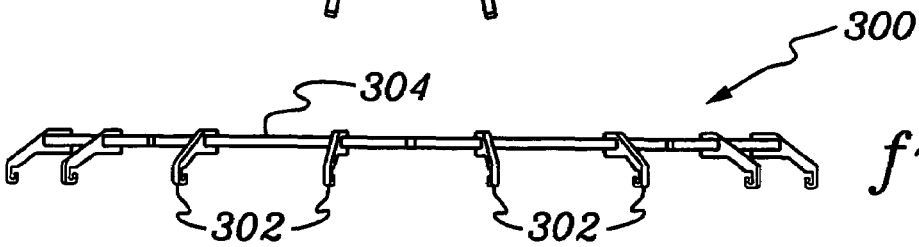
FIG. 50 is an elevation view of the invention shown in FIG. 49.

FIG. 48 is a perspective view of another aspect of the invention 300 providing the hook arrangement 210 shown in FIG. 44. In this aspect of the invention, ornament mounting hook arrangement 210 may be provided in one or more extensions or fingers 302 mounted to a plate, for example, a ring 304. In one aspect of the invention, extensions 302 may be evenly distributed about ring 304. FIG. 49 is a plan view of the aspect of the invention 300 shown in FIG. 48. FIG. 50 is an elevation view of the aspect of the invention 300 shown in FIG. 49. FIG. 51 is a detailed perspective view of the hook arrangement shown in FIG. 48. In one aspect of the invention (not shown), hook arrangement 210 may be machined or stamped into ring 304, for example, as extensions 302 integral with ring 304 which after machining are bent downward to provide access to one or more ornaments (not shown) according to aspects of the invention. In the aspect o the invention shown in FIGS. 48 through 51, hook arrangement 210 is provided in individual or separate extensions 302 which are then mounted to plate 304, for example, by welding, brazing, or adhesives. Extensions 302 and plate 304 may be metallic or non-metallic, for example, made from one or more of the materials described above with respect to connector 70. Ring 304 may include one or more notches 306 positioned on the inside or outside diameter of ring 304 or one or more ribs 308 positioned on the inside or outside of ring 304 to facilitate assembly of ring 304 to a fixture, for example, to a chandelier. In one aspect of the invention, ring 304 and extensions 302 may be fabricated as a single integral part, for example, by casting or forging.

Figure 52:
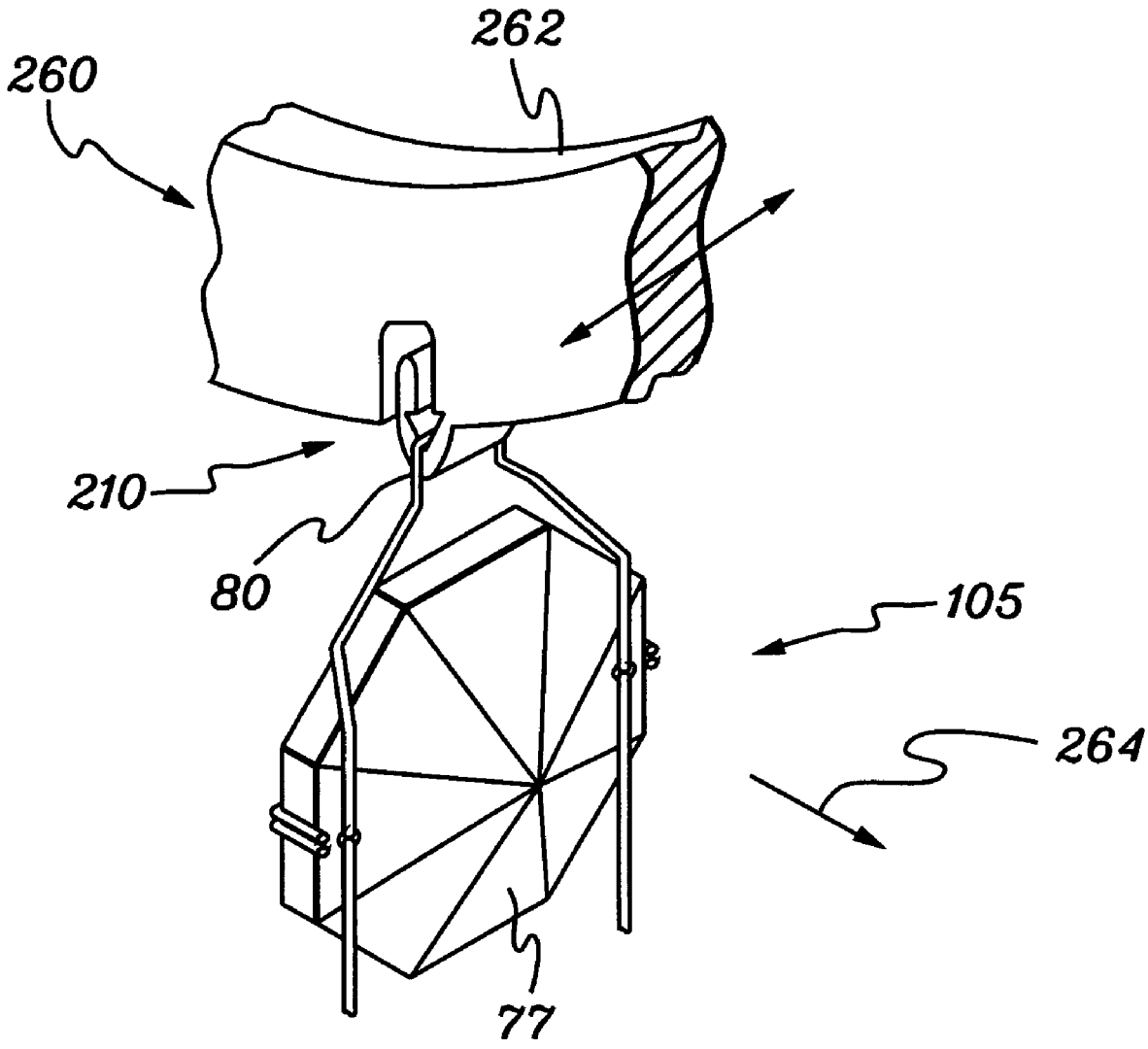
FIG. 52 is a perspective view of the mounting of hook on to a hook arrangement according to another aspect of the invention.

FIG. 52 is a perspective view of an ornament mounting 260 having hook 80 shown in, for example, FIG. 24, mounted to ornament mounting hook arrangement 210 in arm 262, for example, as shown in FIGS. 43 through 51. FIG. 52 illustrates another benefit of the present invention compared to the prior art. As shown in FIG. 52, according to one aspect of the invention, mounting arrangement 210 is adapted for mounting ornaments wherein the twisting of ornaments is minimized or prevented. For example, according to this aspect of the invention, when hook 80 is inserted into hook arrangement 210, the sides of the channel of arrangement 210 (for example, the sides of channel 212 shown in FIG. 44) limit the rotation of hook 80 whereby the orientation of the axis of hook 80 becomes substantially perpendicular to the plane of plate 262. As a result, with little or no twisting, the face of ornament 77 is directed in the most preferred direction, for example, in a radial direction as indicated by arrow 264.

According to another aspect of the invention, as also shown in FIG. 52, ornaments may be mounted to arm 262 whereby assembly is facilitated and parts may be reduced. For example, ornament arrangement 105 shown in FIGS. 24 and 25, having hook 80, may be mounted in mounting arrangement 210 in FIG. 52 whereby the ornament arrangement 105 can be properly oriented without the use of any intermediate hardware, such as hooks or loops. In conventional ornament mountings, for example, as shown in FIG. 1, a through hole 34 is provided in the fixture arm 14. According to the conventional art, in order to orient the ornaments in the desired radial direction, first a ring 42 is inserted into hole 34 to provide a mounting for a hook. The ornament chain 16 in FIG. 1 is then mounted to the ring 42 whereby the ornaments are directed radially. In contrast, according to the present invention, ornament mounting hook arrangement 210, and its related arrangements, provide a structure for mounting and orienting ornaments having hooks, such as hooks 80, without the need for intermediate hardware, such as rings. This aspect of the invention, facilitates assembly of ornamental fixtures, such as chandeliers, and minimized the amount of hardware needed to assemble ornamental fixture. Specifically, as shown in FIG. 52, ornament arrangement 105 having hook 80 may be mounted into passage 212 (see FIG. 44) and the faces of the ornaments of ornament arrangement 105 will be oriented in a direction parallel to the plane of arm 262, for instance, directed in a radial direction toward the view of an observer (as indicated by arrow 264) of, for example, a chandelier. However, unlike prior art mounting methods, for example, as shown in FIG. 1, no intermediate hardware, such as ring 42 in FIG. 2 is necessary to orient ornaments arrangement 105 as preferred.

Figure 53:
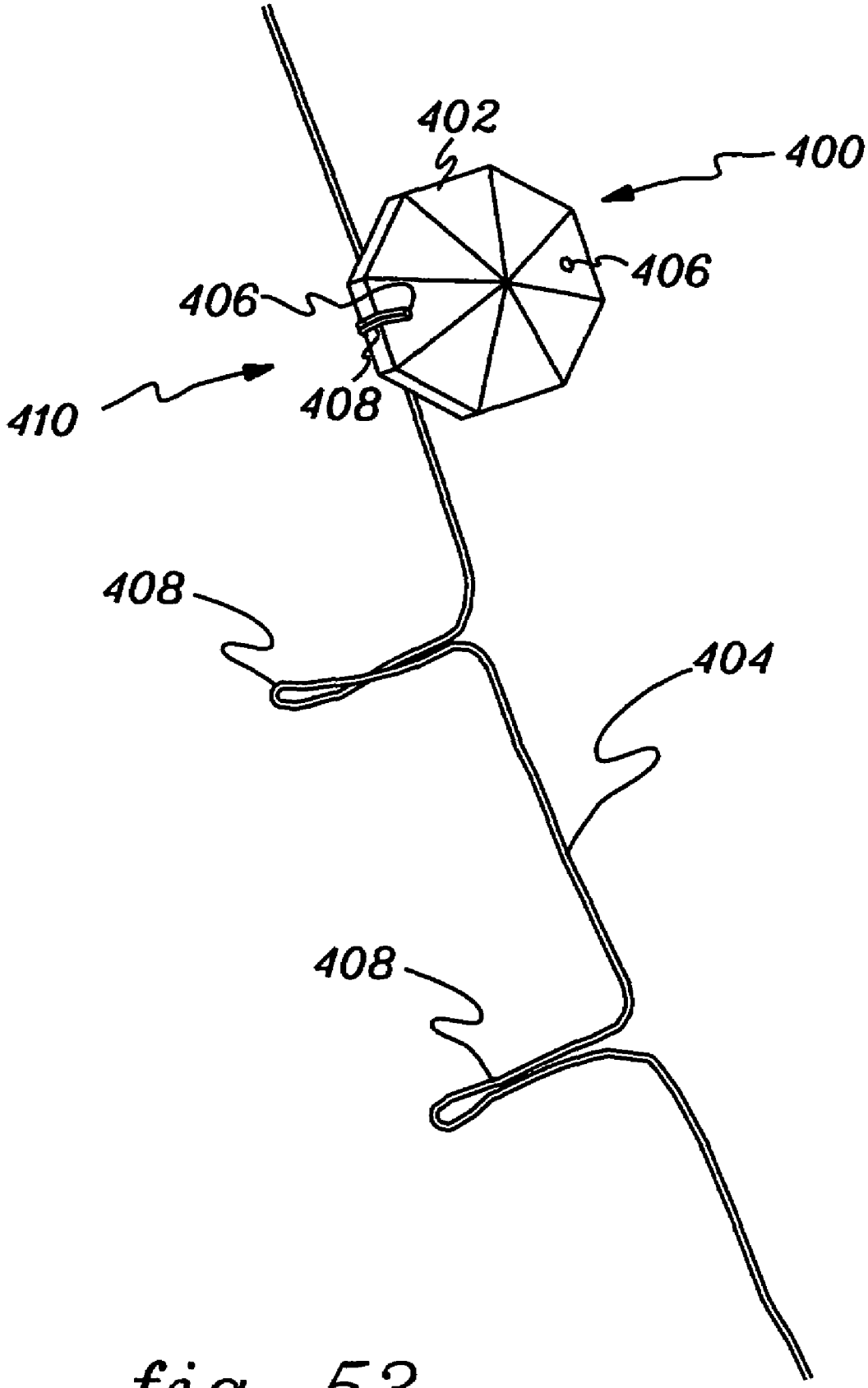
FIG. 53 is a perspective view of another aspect of the invention where the ornaments are connected by a continuous wire connector.

FIG. 53 is a perspective view of an ornament mounting arrangement 400 according to another aspect of the invention. In this aspect of the invention, ornament 402 and other ornaments (not shown), which are similar to or different from ornament 402, may be connected by means of at least one connector 404, for example a continuous connector. In one aspect of the invention, ornament 402 comprises at least one aperture or through hole 406. In another aspect of the invention, ornament 402 comprises at least two apertures or through holes 406. In the aspect of the invention shown in FIG. 53, ornament 402 comprises an octagon crystal jewel having two through holes, though other types of ornaments discussed earlier may be used. In one aspect of the invention, at least two ornaments 402 may be connected by one or more connectors 404. In the aspect of the invention shown in FIG. 53 only a single connector 404 is shown, however, according to one aspect of the invention at least two connectors 404 may be used to connect a plurality of ornaments 402.

According to this aspect of the invention, connector 404 is formed into at least one loop 408, typically, at least two loops 408. Though only three loops 408 are illustrated in FIG. 53, it will apparent to those of skill in the art that any number of loops 408 may be provided in connectors 404 as desired by the design of the fixture. Loops 408 may consist of two or more strands of connector 404 and typically include at least two strands of connector 404. According to this aspect of the invention, loops 408 are inserted into at least one aperture 406 in ornament 402 and then bent over the edge of ornament 402, as shown at arrow 410, to engage loop 408 about ornament 402. In a similar fashion, a second connector 404 (not shown) may be formed into at least one loop 408, and the loop 408 of the second connector 404 may be inserted into and engage the second aperture 406 in ornament 402. This process may be repeated whereby a plurality of ornaments 402 may be mounted to one or more connectors 404 having loops 408. In one aspect of the invention, connectors 404 and ornaments 402 create an ornament chain.

According to one aspect of the invention, loops 408 may engage ornament 402 in a fashion similar to that shown in FIGS. 9 through 23, that is, loops 408 may be bent about crystal 402 in a direction substantially perpendicular to the axis of connector 404. However, in one aspect of the invention, loop 408 may be bent about ornament 402 in a direction that is not perpendicular to the axis of connector 404, for example, loop 408 may be bent about ornament 402 in a direction that is substantially parallel to the axis of connector 404. In another aspect of the invention, at least three ornaments 402 may be connected by one or more connectors 404.

Connector 404 may be metallic or non-metallic, for example, connector 404 may be made from one or more of the metals or plastics described with respect to connector 70. In one aspect of the invention, connector 404 may be made from any material that is formable, for example, formable to conform to the manipulations described above. Again, though connector 404 is illustrated as generally circular, connector 404 may have a variety of cross-sectional shapes; for example, connector 404 may have a cross-sectional shape that is circular, ellipsoidal, triangular, rectangular, square, or any other polygonal shape. According to one aspect of the invention, connector 404 may be made from coated or uncoated metal wire. For example, connector 404 may be made from about 0.010 inch wire to about 0.125 inch wire, for example, wire having a diameter from about 0.020 inches to about 0.030 inches. In one aspect of the invention, connector 404 is made from nickel-chrome wire having a diameter of about 0.026 inches.

According to one aspect of the invention, a chain of two or more ornaments 402 assembled according the this aspect of the invention described above may include one or more connectors 70 and be terminated using hook 80 and/or connector 90 described above.

Figure 54:
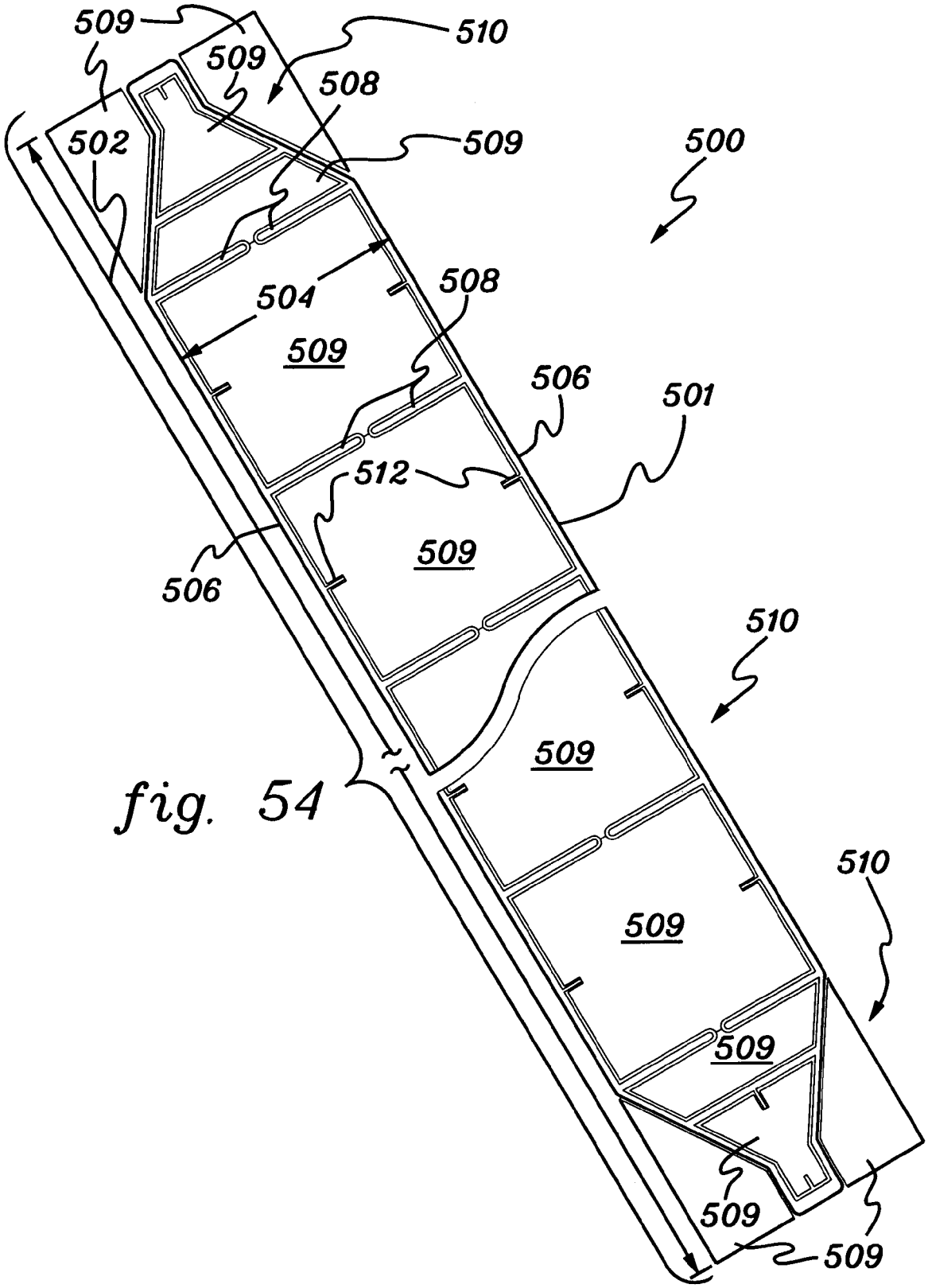
FIG. 54 is a plan view of a machined plate of indeterminate length according to a further aspect of the invention.
Figure 55:
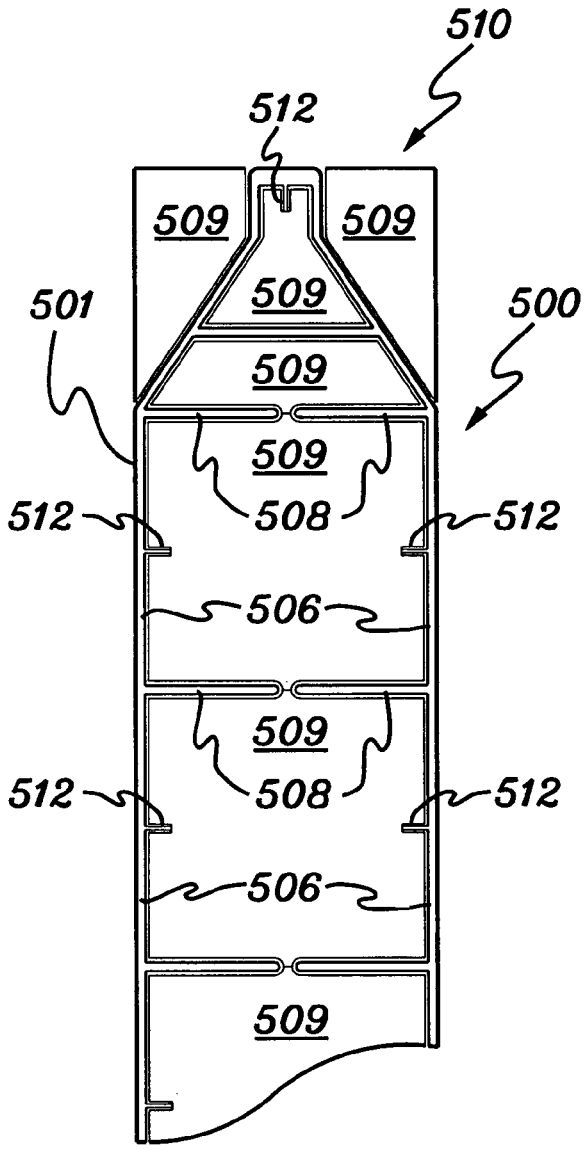
FIG. 55 is a detailed view of the machined plate shown in FIG. 54.

FIGS. 54 through 61 illustrate further aspects of the invention. FIG. 54 is a plan view of an ornament mounting structure or device 500 comprising a machined plate 501 of length 502 and width 504 according to a further aspect of the invention. FIG. 55 provides a detailed view of one end of structure 500 shown in FIG. 54. Device or structure 500 may be referred to as a "chain." According to one aspect of the invention, structure 500 may be machined from plate 501 to provide at least two elongated support members or spines 506 and a plurality of posts or pins 508. The excess plate material removed from plate 501, or the "scrap plate," 509 may be removed by conventional means, for example, punching or manual removal. Plate 501 may be made from any suitable metallic or non-metallic material, for example, may be made from one or more of the following metals: iron, steel, stainless steel, aluminum, titanium, nickel, brass, bronze, copper, silver, or gold, among other metals. In one aspect of the invention, plate 501 may be non-metallic, for example, made from plastic, such as one or more of the following plastics: a polyamide (PA), for example, nylon; a polyethylene (PE); a polypropylene (PP); a polyester (PE); a polytetraflouroethylene (PTFE); an acrylonitrile butadiene styrene (ABS); a polycarbonate (PC); or a polyvinylchloride (PVC), among other plastics.

According to aspects of the present invention, plate 501 may be machined by any conventional process for machining plate, including blanking, punching, milling, drilling, sawing, water-jet cutting, electron beam machining (EBM), laser cutting, electrical discharge machining (EDM), including wire EDM, and plasma beam machining, among other methods. These machining processes may be practiced conventionally or by means of computerized numerically controlled (CNC) methods. In one aspect of the invention, the incisions in plate 501 may be cut by laser, for example, by means of a CNC programmable laser. When laser cut, the width of the incisions in plate 501 may range from about 0.002 inches to about 0.015 inches, for example, between about 0.005 inches and about 0.010 inches.

As shown in FIGS. 54 and 55, machined plate 501 may be machined to provide at least one ornament chain mounting means 510 for mounting the completed and ornamented structure to a fixture, for example, to a chandelier, a light fixture, or a wall sconce.

Machined plate 501 may have a length 502 that may range from about 1 inch to about 20 feet, but is typically between about 6 inches and about 6 feet, for example, about 4 feet. Machined plate 501 may have a width 504 that may range from about 0.125 inches to about 3 feet, but is typically between about 0.25 inches and about 2 feet, for example, about 1 inch. Machined plate 501 may have a thickness that may range from about 0.001 inches to about 0.25 inches, but is typically between about 0.005 inches and about 0.050 inches, for example, between about 0.020 and about 0.025 inches.

Figure 56:
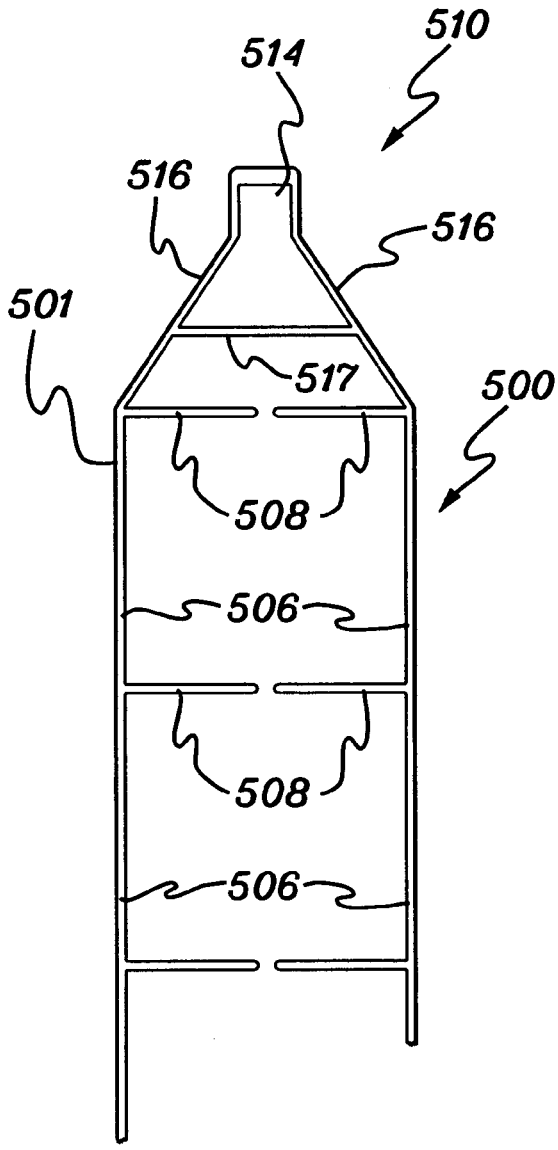
FIG. 56 is a detailed view similar to the view shown in FIG. 55, but with scrap plate removed.

FIG. 56 is a detailed view of one end of structure 500 similar to the view shown in FIG. 55, but with scrap plate 509 removed. The scrap plate 509 may be removed from plate 501 by conventional means, for example, manually or automatedly. In one aspect, the scrap plate 509 may be punched out by means of an automated punch mechanism, for example, by means of a Gattling gun-type device. The resulting spines 506 may have a width ranging from about 0.005 inches to about 0.375 inches, for example, between about 0.015 and about 0.050 inches. The resulting posts 508 may have a width ranging from about 0.002 inches to about 0.125 inches, for example, between about 0.015 inches and about 0.050 inches, and an length ranging from about 0.063 inches to about 1 inch, for example, between about 0.125 inches and about 0.50 inches.

As shown in FIGS. 55 and 56, in one aspect of the invention, where plate 501 is laser cut, small projections or "micro tabs" 512 may be machined into spines 506. In one aspect, these micro tabs 512 may be provided to stabilize the machined spine 506, for example, to minimize the "stringiness" of the spine 506 during or after laser cutting. Micro tabs 512 may have a width ranging from about 0.002 inches to about 0.125 inches, for example, between about 0.005 inches and about 0.025 inches, and a length ranging from about 0.005 inches to about 0.50 inches, for example, between about 0.015 inches and about 0.10 inches.

Mounting means 510 may comprise any means for providing a structure from which spines 506 may be mounted, for example, mounted to a gallery ring 114 or 116 as shown in and described with respect to FIG. 26, to support ring 300 as shown in and described with respect to FIGS. 48-51, or to a support arm as shown in and described with respect to FIGS. 43-47 and 52, among other structures. As shown in FIG. 54, at least one mounting means 510 may be provided, for example, two mounting means 510 may be provided at either end of plate 501. As shown in FIG. 56, according to one aspect, mounting means 510 may include at least one aperture 514 that may be adapted to be attached to a support structure. Aperture 514 may be round or polygonal, for example, rectangular as shown. The size of aperture 514 may vary widely depending upon, among other things, the size of the ornaments being suspended or the length 502 of spines 506. In one aspect, aperture 514 may have a width ranging from about 0.005 inches to about 3 inches, for example, between about 0.025 inches and about 0.28 inches, and a length ranging from about 0.030 inches to about 1 inch, for example, between about 0.060 inches and about 0.25 inches. Aperture 514 may be attached to spines 506 by conventional means, for example, as shown in FIG. 56, mounting means 510 may include at least one spar 516, typically, at least two spars 516, that attach aperture 514 to spines 506. In one aspect of the invention, mounting means 510 may include one or more transverse braces 517, for example, extending between spars 516. One or more braces 517 may increase structural rigidity of the mounting means 510.

Figure 57:
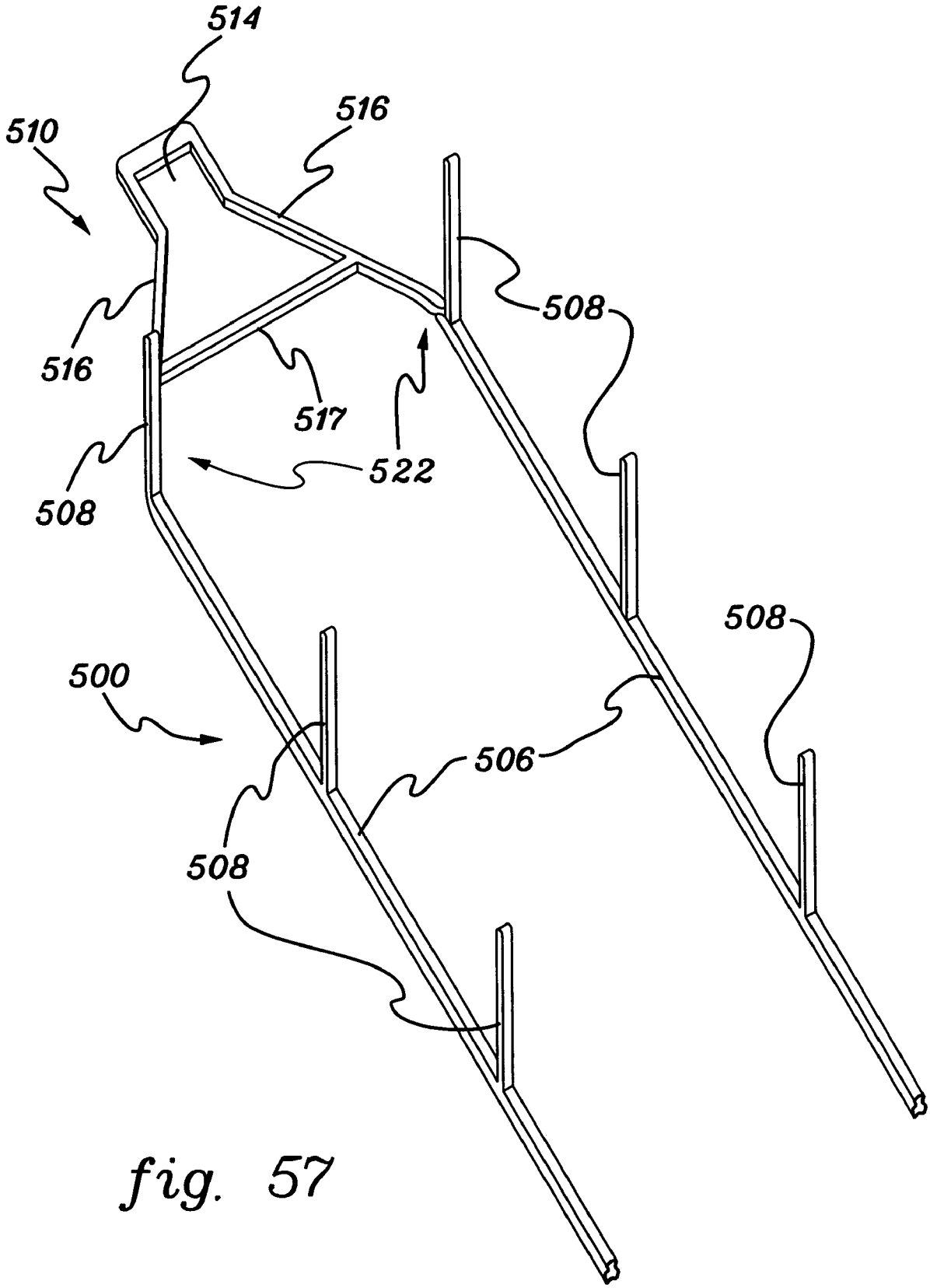
FIG. 57 is a perspective view of the aspect of the invention shown in FIG. 56 having the mounting posts deflected according to one aspect of the invention.

After fabricating spines 506 and posts 508, posts 508 may typically be deflected or otherwise adapted whereby ornaments, for example, crystal ornaments, may be mounted to posts 508. FIG. 57 is a perspective view of the aspect of the invention shown in FIG. 56 having the mounting posts 508 deflected or bent according to one aspect of the invention. The amount of displacement or deflection of posts 508 may vary depending upon, among other things, the type of ornaments being mounted to posts 508 and the material from which posts 508 are made. In one aspect of the invention, posts 508 may be deflected at least 15 degrees. However, in a typical aspect of the invention posts 508 may be deflected approximately 90 degrees, for example, where posts 508 are substantially perpendicular to the plane defined by spines 506. Posts 508 may be deflected manually, automatedly, or semi-automatedly, for example, by means of one or more automated manipulators.

In one aspect of the invention, posts 508 may be deflected or bent or otherwise adapted by bending posts 508 with respect to spines 506, for example, bent in the vicinity of the intersection of posts 508 and spine 506. In one aspect, for example, due to the thickness of spines 506, posts 508 may not be bent in the vicinity of the intersection of posts 508 and spines 506, but spines 506 may be rotated or twisted to provide the desired perpendicular orientation of posts 508, for example, perpendicular to the plane defined by spines 506. In one aspect of the invention, spines 506 may be bent, rotated, or twisted in the vicinity of or adjacent to the mounting means 510, for example, in the vicinity of the posts 508 adjacent to mounting mechanism 510, that is, the "first posts" on each end of the chain 500. This aspect of the invention is illustrated in FIG. 57 as indicated by reference number 522, where the geometry of the spine 506 transitions to the geometry of the mounting means 510.

Figure 58:
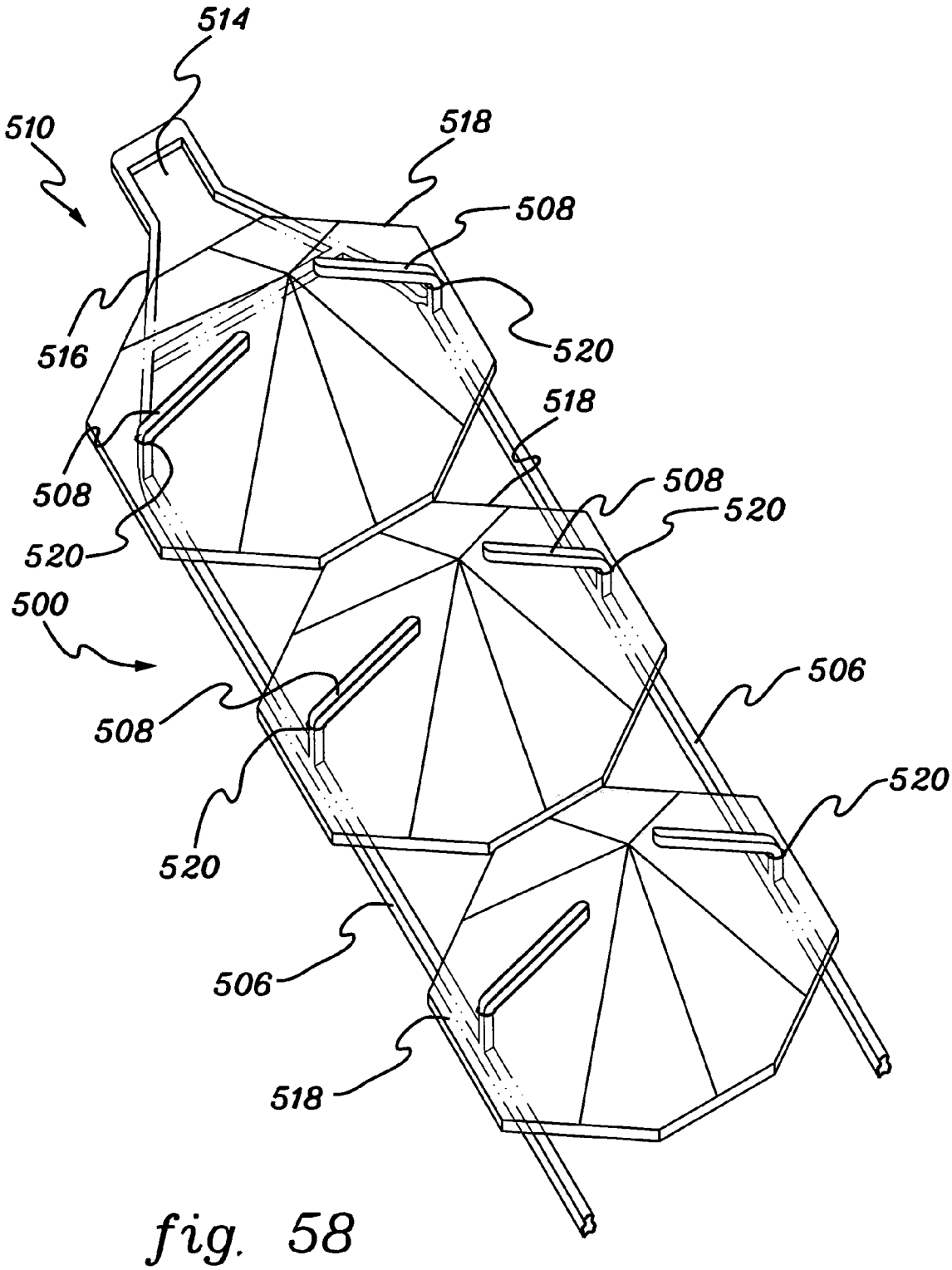
FIG. 58 is a perspective view similar to FIG. 57 having ornaments mounted to the mounting posts according to one aspect of the invention.
Figure 59:
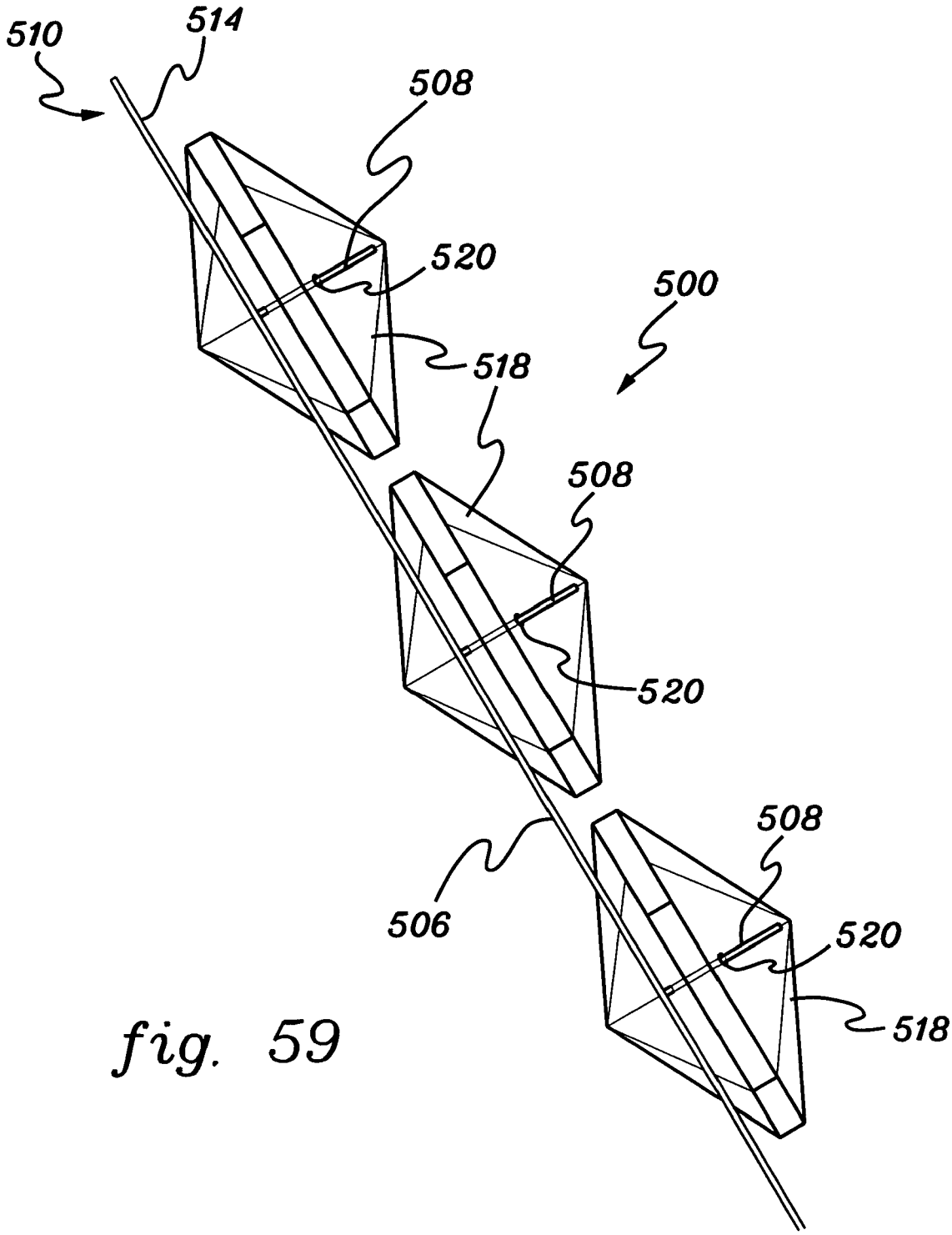
FIG. 59 is a side elevation view of the aspect of the invention shown in FIG. 58.

According to aspects of the present invention, posts 508 are adapted to accept one or more ornaments. FIG. 58 is a perspective view similar to FIG. 57 having at least one ornament 518 mounted to at least one of the mounting posts 508 according to one aspect of the invention. FIG. 59 is a side elevation view of support structure 500 shown in FIG. 58. Ornament 518 may comprise any one or more of the ornaments described above with respect to ornaments 62 and 64. In the aspect of the invention illustrated in FIGS. 58 and 59, ornaments 518 may be octagonal crystals, for example, octagonal crystals provided by D. Swarovski & Co. of Wattens, Austria, or their equivalent. As shown, ornaments 518 may typically have at least one perforation or through hole 520 through which posts 508 may pass to mount ornaments 518 to support structure 500. Ornaments 518 may be retained on posts 508 by conventional means, for example, by bending or kinking posts 508 in an appropriate direction and to an appropriate degree, for example, at least 5 degrees, to retain ornament 518. As shown in FIGS. 58 and 59, in one aspect of the invention, ornaments 518 may be retained on posts 508 by bending or kinking post 508 in a direction substantially transverse the axis of support structure 500, for example, by bending posts 508 inward toward the centerline of structure 500. In another aspect of the invention, posts 508 may be bent or kinked in a direction substantially parallel to the axis of the support structure 500, or at any oblique direction there between substantially parallel and substantially transverse. The mounting of ornaments 518 and the bending or kinking of posts 508 to retain ornaments 518 may be practiced manually, automatedly, or semi-automatedly, for example, by means of one or more automated manipulators.

In one aspect of the invention, for example, as shown in FIGS. 58 and 59, one or more ornaments 518, having one or more perforations 520, may be mounted on one or more mounting posts 508. For example, in one aspect, one or more ornaments 518 may be mounted on adjacent mounting posts 508 where each post 508 is mounted on a separate spine 506. However, in one aspect of the invention, ornaments 518 may be mounted on mounting posts 508 that are mounted on the same spine 506. That is, depending upon the size and shape of ornaments 518 used, among other things, ornaments 518 may be longitudinally mounted on successive posts 508 on a single spine 506 or laterally mounted on separate spines 506, as shown on FIGS. 58 and 59. In one aspect, the ornaments engaging mounting posts 508 on separate spines 506 may engage laterally adjacent posts 508 or engage posts 508 positioned above or below, wherein ornament 518 may be oriented at an oblique angle to spines 506, for example, at an angle of about 45 degrees. In addition, in one aspect, ornament 518 may include 3 or more perforations 520 and engage 3 or more posts 508. For example, in one aspect, ornament 518 may include 4 perforations which engage 4 mounting posts on device 500.

Figure 60:
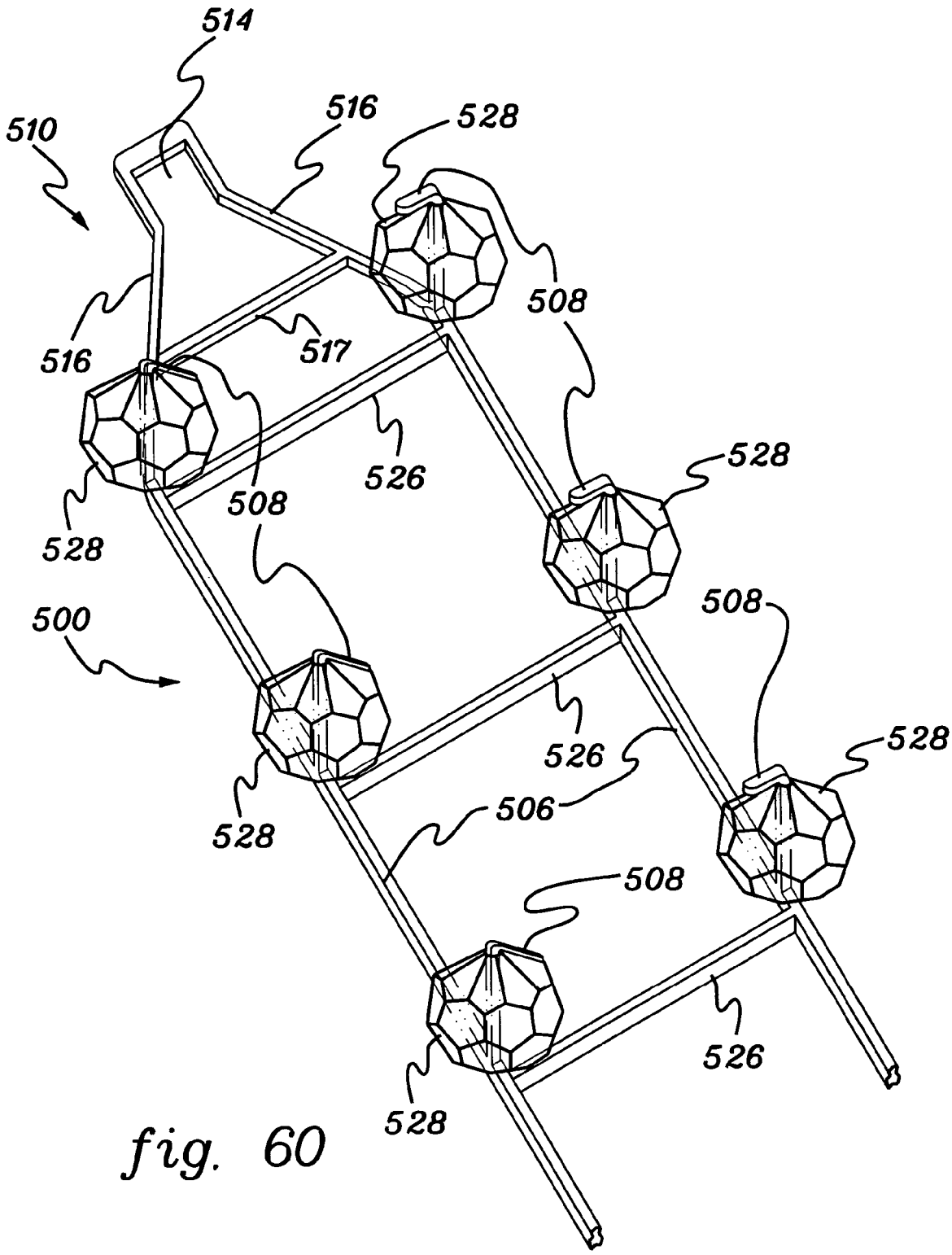
FIG. 60 is a perspective view similar to FIG. 58 having ornaments mounted according to another aspect of the invention.

FIG. 60 is a perspective view similar to FIG. 58 having at least one ornament 528 mounted to at least one mounting post 508 according to another aspect of the invention. In this aspect of the invention, individual ornaments 528 having at least one perforation 520 may be mounted to individual mounting posts 508. In one aspect of the invention, the structural integrity of device 500 may be enhanced by introducing one or more cross braces 526 between spines 506. According to this aspect of the invention, posts 508 and braces 526 may also be fabricated from the same plate, specifically, by machining posts 508 and braces 526 whereby they are axially displaced from each other along plate 501. In one aspect of the invention, braces 526 may be positioned adjacent posts 508 in FIG. 60 whereby ornaments 528 at least partially conceal braces 526.

In another aspect of the invention, the braces 526 shown FIG. 60 may be omitted whereby an ornament arrangement comprising one or more elongated spines 506 may be provided. For example, in one aspect of the invention, a single elongated spine 506 may be provided having one or more posts 508 on which one or more ornaments 528 may be mounted. The one or more spines 506 having ornaments 528 may be mounted to individual mounting means, for example, similar to mounting means 510, or one or more spines 506 having ornaments 528 may be mounted to a common mounting means 510, as shown in FIG. 60. In one aspect of the invention, the one or more spines 506 having ornaments 528 may be further manipulated, for example, the one or more spines 506 having ornaments 528 may be bent, twisted, or otherwise plastically deformed to provide an arrangement for displaying ornaments 528. For example, in one aspect, one or more ornamented spines 506 may be twisted to provide a twisted or helical display of ornaments 528. In another aspect of the invention, the one or more ornamented spines 506 may be plastically bent, for example, bent at least 5 degrees, for instance, about 45 degrees, at a location between posts 508, to provide an angled or polygonal display of ornaments 528.

Figure 61:
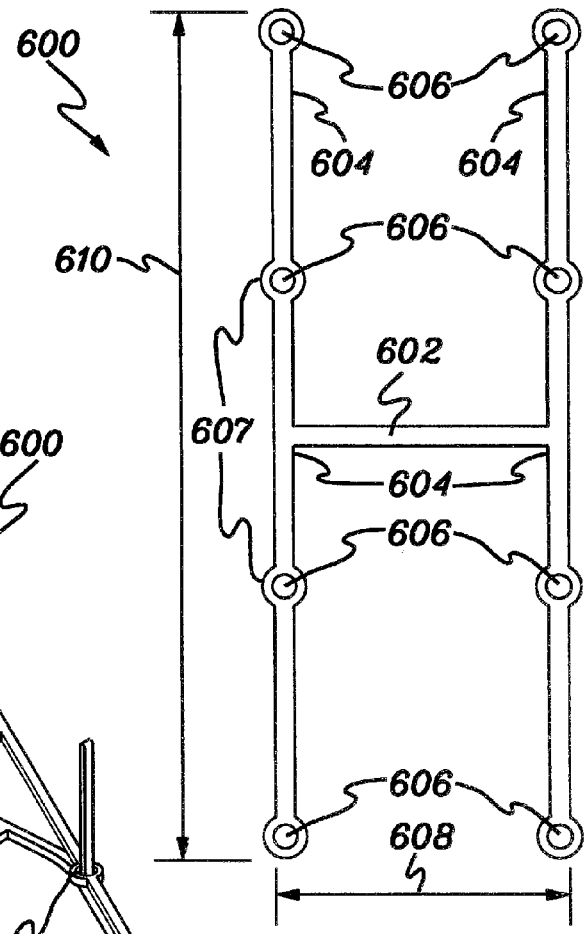
FIG. 61 is a plan view of a connector according to another aspect of the invention.

FIG. 61 is a plan view of a connector 600 according to another aspect of the invention. Connector 600 may be termed an "H connector" due to its shape. According to one aspect of the invention, connector 600 may be used to connect one "chain" of ornaments to another chain of ornaments to provide, for example, a longer chain of ornaments, for example, for attaching two or more chains 500 with ornaments 518 shown in FIG. 58.

According to one aspect, connector 600 may be fabricated from plate, for example, fabricated by one or more of the machining processes discussed herein, for example, laser cutting. In one aspect of the invention, connector 600 may be fabricated from a plate having a thickness less than about 0.25 inches, for example, less than about 0.050 inches. Connector 600 may be fabricated from one or more of the metals or plastics discussed with respect to other aspects of the invention.

As shown in FIG. 61, connector 600 typically may include one or more cross pieces or bars 602, and a plurality of uprights or projections 604 mounted to cross bar 602. In one aspect of the invention, each upright 604 includes at least one perforation 606, for example, a circular hole 606, and typically at least two perforations 606. In one aspect of the invention, perforations 606 may be accompanied by enlargements 607 in uprights 606, for example, enlargements to accommodate the size of perforation 606 in relation to the thickness of projections 604. Though perforations 606 and enlargements 607 are shown as circular in FIG. 61, perforations 606 and enlargements 607 may take any geometric shape, including square, oval, and rectangular. According to one aspect of the present invention, perforations 606 engage pins or posts, for example, posts 508, shown in FIGS. 57 and 58, to attach one ornament chain to another ornament chain. In one aspect, connector 600 may have a width 608 ranging from about 0.125 inches to about 3 feet, for example, between about 0.375 inches and about 2 inches, and a length 610 ranging from about 0.125 inches to about 3 feet, for example, between about 0.375 inches and about 2 inches.

Figure 62:
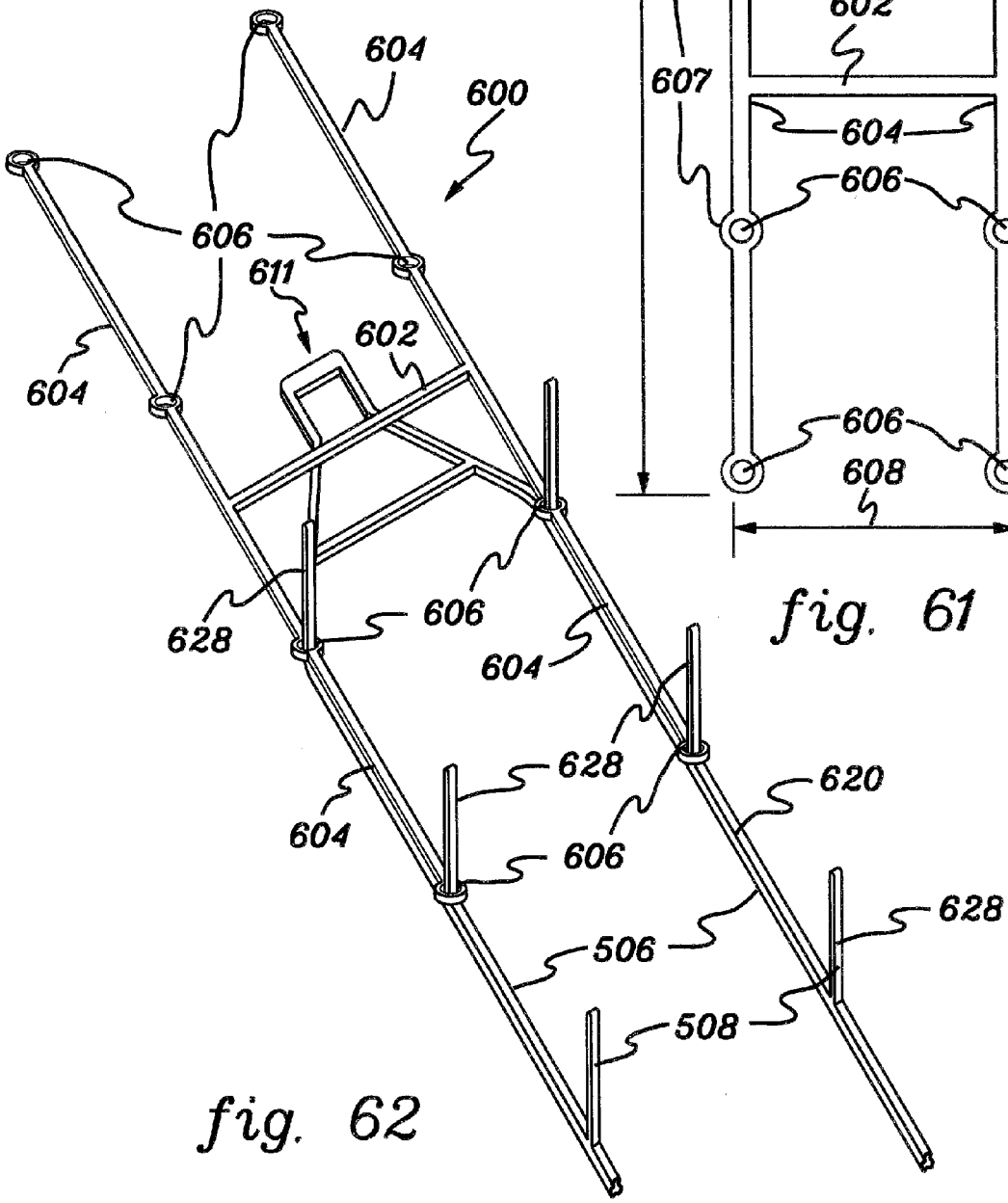
FIG. 62 is a perspective of the mounting of the connector shown in FIG. 61.

FIG. 62 is a perspective of the mounting of the connector 600 shown in FIG. 61 to a ornament mounting device 620 having posts or pins 628. Mounting device 620 may be similar to device 500 shown in FIGS. 57 and 58. Device 620 typically will have one or more ornaments mounted to pins 628 as is typical of aspects of the present invention. As shown in FIG. 62, according to one aspect of the invention, the perforations 606 in connector 600 engage at least one of the posts 628 on mounting device 620. According to this aspect of the invention, connector 600 may engage a second device 620 (not shown) in a similar manner to couple two or more devices 620 to form an extended ornament chain. In one aspect of the invention, device 620 may include a mounting means 611, for example, a mounting means similar to mounting means 510 shown in FIGS. 57 and 58, and connector 600 may overlay mounting means 611. In another aspect of the invention, device 620 may not include mounting means 611, for example, mounting means 611 may be omitted from one or more ends of devices 620, for example, to avoid interference with a mounting means of an adjacent device 620. In one aspect, wherein mounting means 611 may be omitted, the one end of device 620 shown in FIG. 62 may simply comprise spines 506 with posts 628, for example, with no connecting bars there between. As shown in FIG. 62, in one aspect of the invention, at least two of the perforations 606 on each upright 604 of connector 600 engage at least two posts 628 on device 620. According to aspects of the invention, two or more devices 620 having ornaments (not shown) may be coupled by means of one or more connectors 600, for example, three or more, or five or more, devices 620 may be coupled, for example, as dictated by the designer or the installation. Though not shown in FIG. 62, in one aspect of the invention, after posts 628 engage perforations 606, connector 600 may be retained on device 620 by bending posts 628 to provide an obstruction to the removal of connector 600 from posts 628. In one aspect of the invention, an ornament (not shown), such as a two-holed octagon crystal, may be assembled onto posts 628 above, or in some instances below, connector 600. In one aspect, the ornament assembled on to posts 628 may at least partially obscure the connector 600 from the view of the observer.

Figure 63:
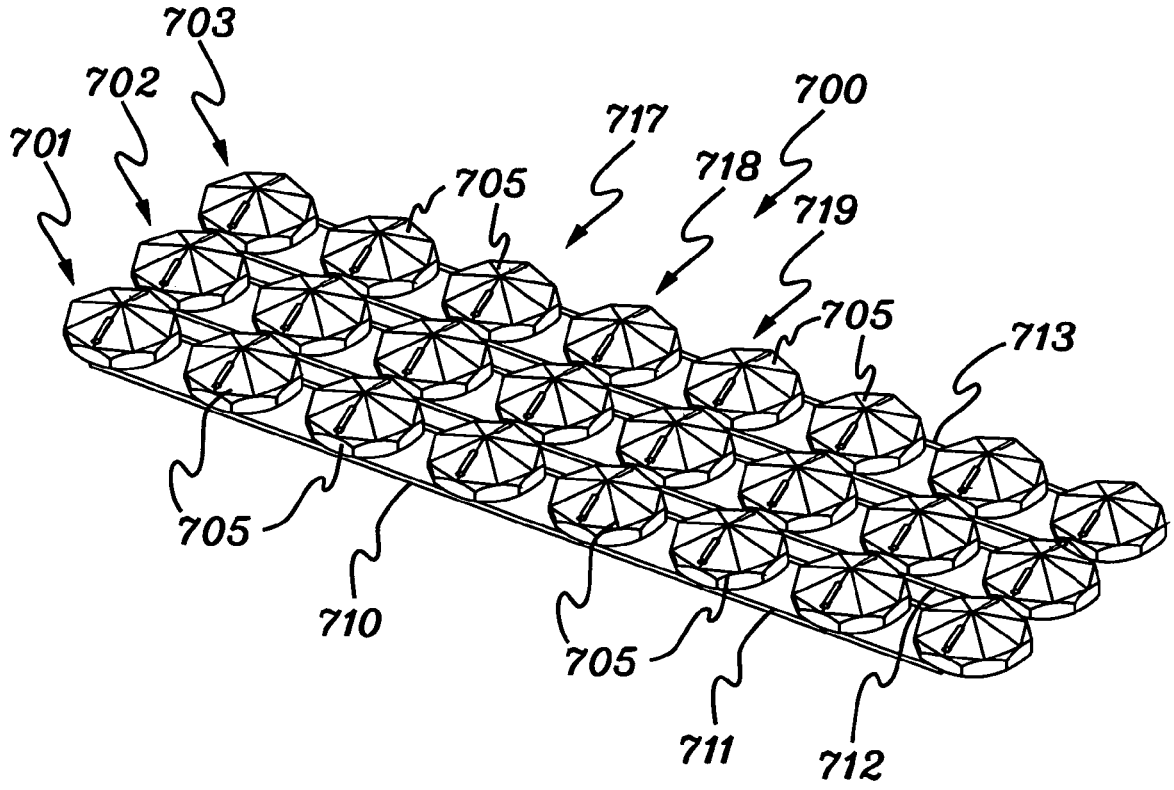
FIG. 63 is a perspective view of a further aspect of the invention.
Figure 64:
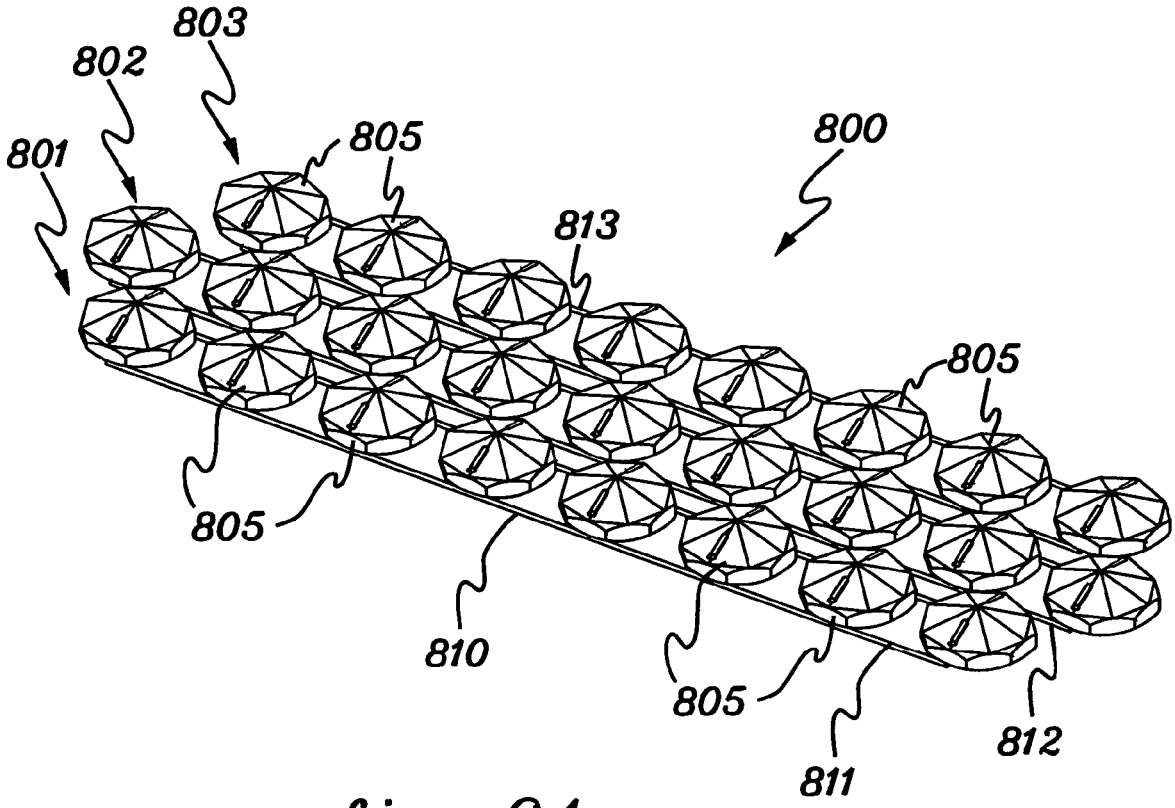
FIG. 64 is a perspective view of another further aspect of the invention.

FIGS. 63 and 64 are perspective views of further aspects of the invention. FIG. 63 is a perspective view of an ornament arrangement 700 having a plurality of rows 701, 702, and 703 of ornaments 705. In the aspect shown in FIG. 63 ornaments 705 comprise ornamental octagon crystals, though any of the ornaments discussed above may be used. Though three rows are illustrated, according to one aspect of the invention two or more, or 5 or more, rows of ornaments 705 may be provided. Arrangement 700 includes an ornament mounting device 710. According to one aspect of the invention, mounting device 710 may be similar in structure and function to device 500 shown in FIGS. 57 and 58. For example, each row 701, 702, and 703 of ornaments 705 in FIG. 63 may comprise a structure 711, 712, and 713 similar to the structure of device 500 shown in FIGS. 57 and 58. For example, structures 711, 712 and 713 may typically include two spines, similar to spines 506 in FIG. 57, and a plurality of mounting posts, similar to mounting posts 508 in FIG. 57. In the aspect of the invention shown in FIG. 63, the mounting posts may be adapted to mount ornaments 705 in a series of parallel rows, for example, as indicated by arrows 717, 718, and 719 wherein adjacent ornaments 705 may be positioned generally in line with each other, for example, wherein the centerlines of adjacent ornaments are generally in line with each other. According to one aspect, structures 712, 713 and 714 may be interconnected by some form of connecting means (not shown in FIG. 63), for example, a bar, pin, plate, or rod, among other structures, that connect, for example, structure 711 to structure 712 and structure 712 to structure 713. In one aspect, structures 711, 712, and 713 and the respective connecting means may be made from one or more of the metals or plastics discussed above and may be fabricated from plate, as discussed for other aspects of the invention, for example, from one or more of the machining processes discussed above. In one aspect, structures 711, 712, and 713 and the respective connecting means may be fabricated by laser cutting plate. In another aspect of the invention, at least one of structures 711, 712, or 713 may be fabricated from plate and the connecting means may be provided by other fabrication methods, for example, by means of welding, brazing, adhesives, or mechanical fasteners. Though not shown in FIG. 63, device 700 may include one or more mounting means to mount device 700 to a structure, for example, a mounting means similar to mounting means 514 shown in FIGS. 57 and 58.

FIG. 64 is a perspective view of an ornament arrangement 800. Similar to arrangement 700 shown in FIG. 63, arrangement 800 includes a plurality of rows 801, 802, and 803 of ornaments 805. In the aspect shown in FIG. 64 ornaments 805 comprise ornamental octagon crystals, though any of the ornaments discussed above may be used. Again, though three rows are illustrated in FIG. 64, according to one aspect of the invention two or more, or 5 or more, rows of rearmaments 805 may be provided. Arrangement 800 includes an ornament mounting device 810. According to one aspect of the invention, mounting device 810 may be similar in structure and function to device 500 shown in FIGS. 57 and 58 and device 710 shown in FIG. 63. For example, each row 801, 802, and 803 of ornaments 805 in FIG. 64 may comprise a structure 811, 812, and 813 similar to the structure and function of device 500 shown in FIGS. 57 and 58 and structures 711, 712, and 713 shown in FIG. 63. For example, structures 811, 812 and 813 may typically include two spines, similar to spines 506 in FIG. 57, and a plurality of mounting posts, similar to mounting posts 508 in FIG. 57. In the aspect of the invention shown in FIG. 64, the mounting posts may be adapted to mount ornaments 805 in a staggered arrangement, for example, wherein the centerlines of adjacent ornaments do not line up or coincide. In one aspect, the centerlines of an ornament is positioned midway between the centerlines of adjacent ornaments. According to one aspect, and similar to arrangement 700 in FIG. 63, structures 812, 813 and 814 may be interconnected by some form of connecting means (not shown in FIG. 64) for example, a bar, pin, plate, or rod, among other structures. In one aspect, structures 811, 812, and 813 and the respective connecting means may be made from one or more of the metals or plastics discussed above and may be fabricated from plate, as discussed for other aspects of the invention, for example, from one or more of the machining processes discussed above. In another aspect of the invention, at least one of structures 811, 812, or 813 may be fabricated from plate and the connecting means may be provided by other fabrication methods, for example, by means of welding, brazing, adhesives, or mechanical fasteners. Though not shown in FIG. 64, device 800 may include one or more mounting means to mount device 800 to a structure, for example, a mounting means similar to mounting means 514 shown in FIGS. 57 and 58.

Figure 65:
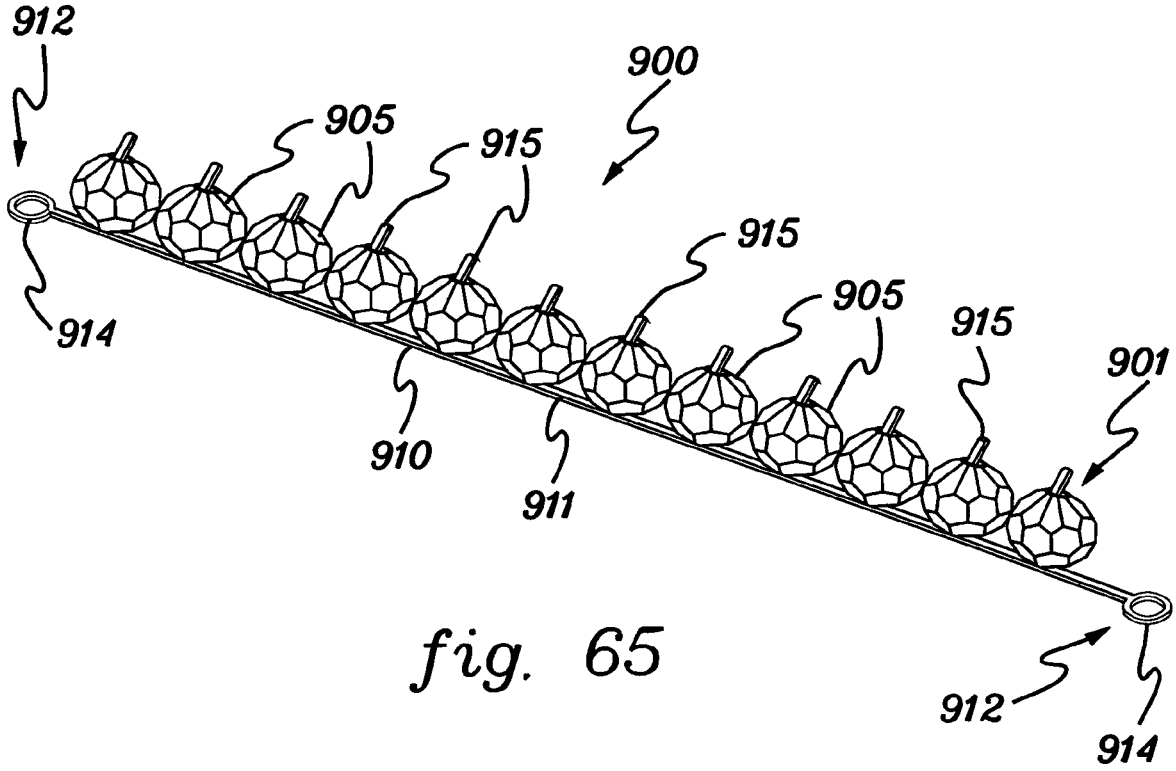
FIG. 65 is a perspective view of another aspect of the invention.
Figure 66:
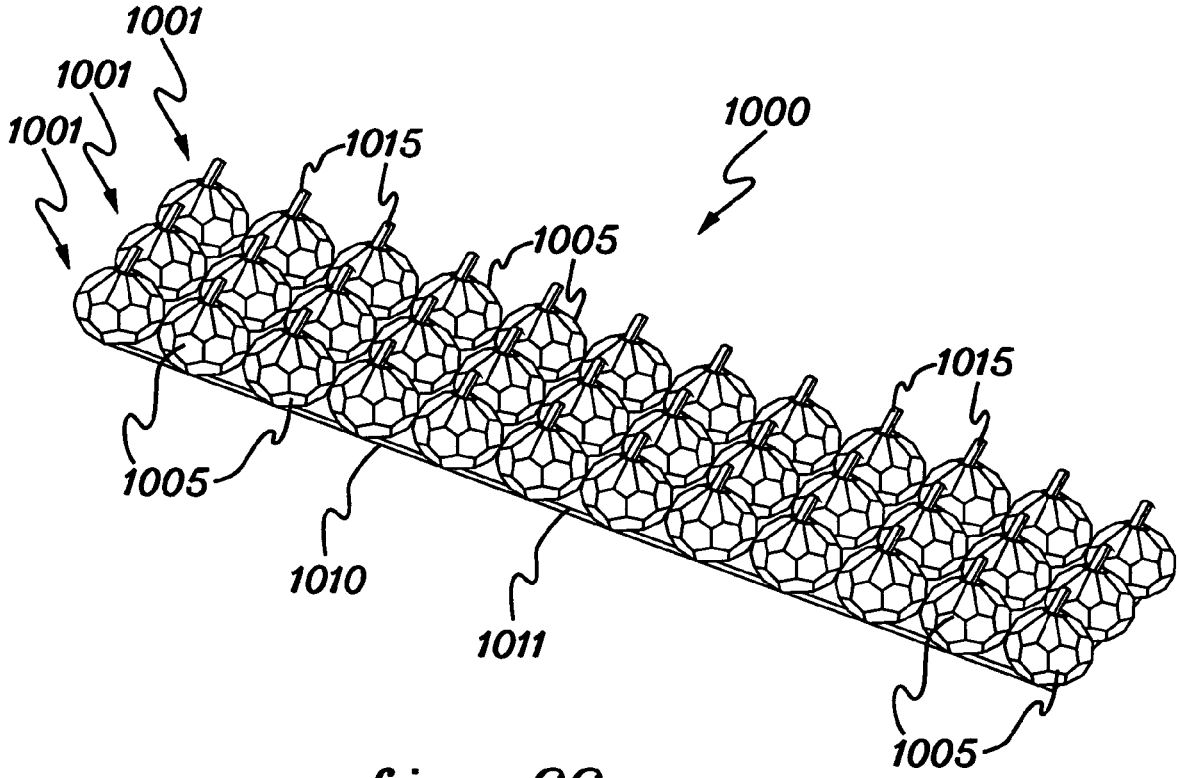
FIG. 66 is a perspective view of another aspect of the invention.
Figure 67:
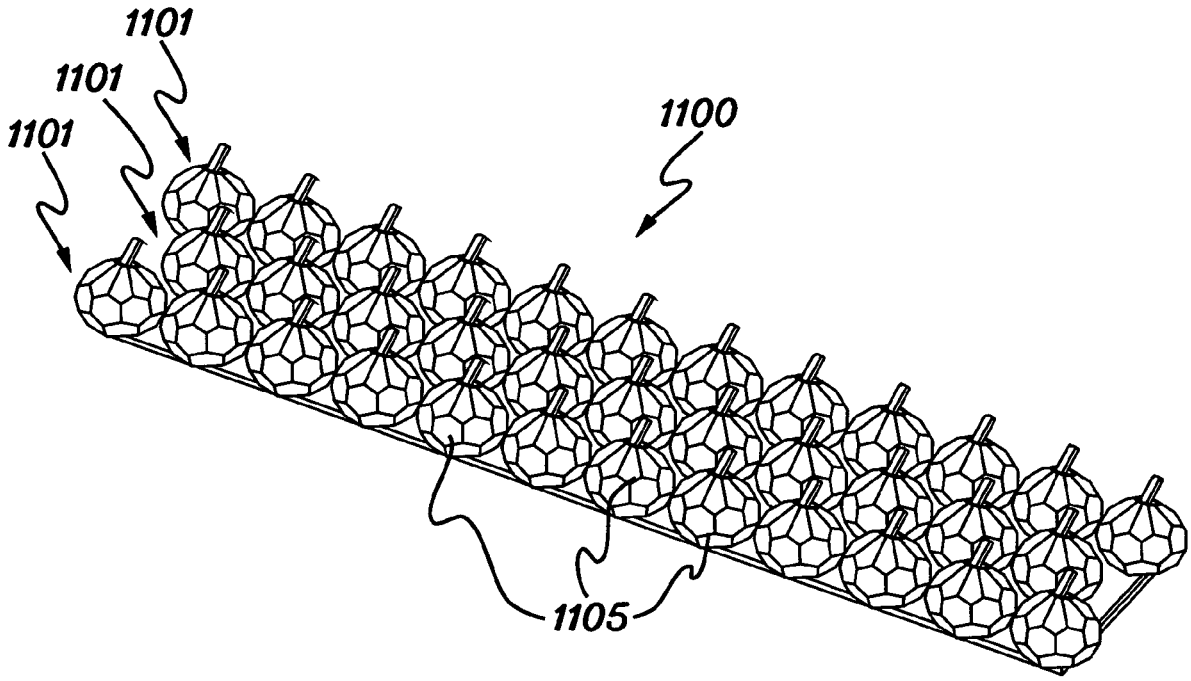
FIG. 67 is a perspective view of another aspect of the invention.

FIGS. 65, 66, and 67 are perspective views further aspects of the invention. FIG. 65 is a perspective view of an ornament arrangement 900 having a row 901 of ornaments 905. In the aspect shown in FIG. 65 ornaments 905 comprise ornamental faceted spheres, though any of the ornaments discussed above may be used. Though only a single row 901 is illustrated, according to one aspect of the invention two or more, or 5 or more, rows 901 of ornaments 905 may be provided. Arrangement 900 includes an ornament mounting device 910. According to one aspect of the invention, mounting device 910 may be similar in structure and function to device 500 shown in FIGS. 57 and 58. As shown in FIG. 65, device 910 comprises a spine, rod, or bar 911 and may or may not include one or more mounting means 912. In one aspect of the invention mounting means 912 may simply comprise a ring or loop 914, but in other aspects, mounting means 914 may comprise a hook or related structure. In one aspect of the invention, device 910 may include structures similar to the structure of device 500 shown in FIGS. 57 and 58. For example, device 910 may typically include a plurality of mounting posts or pins 915, similar to mounting posts 508 in FIG. 57. In the aspect of the invention shown in FIG. 65, the mounting posts 915 may be adapted to mount ornaments 905 in one or more rows 901. Similar to the earlier aspects of the invention, posts 915 may be adapted to retain ornaments 905, for example, posts 915 may be kinked or otherwise bent to provide an obstruction to the removal of ornaments 905. In one aspect, device 910 may be made from one or more of the metals or plastics discussed above and may be fabricated from plate, as discussed for other aspects of the invention, for example, from one or more of the machining processes discussed above, for example, by laser cutting from plate. In one aspect, after device 910 is fabricated from plate, posts 915 may be deflected out of the plane of mounting means 912. For example, in one aspect, posts 915 may be plastically deflected in the vicinity of their intersection with spine 911 to provide a mounting for ornaments 905. In another aspect, spine 911 may be rotated relative to mounting means 914 to deflect post 915 relative to mounting means 914, for example, plastically twisted between the end most mounting post and the ring 914. In another aspect, device 911 may be cut from plate were at least one ring 914 and posts 915 are directed substantially in the same plane and no twisting or deflection is required.

FIG. 66 is a perspective view of an ornament arrangement 1000 having a plurality of rows 1001 of ornaments 1005. In the aspect shown in FIG. 66 ornaments 1005 comprise ornamental faceted spheres, though any of the ornaments discussed above may be used. Though three rows 1001 are illustrated, according to one aspect of the invention two or more, or 5 or more, rows 1001 of ornaments 1005 may be provided. Arrangement 1000 includes an ornament mounting device or frame 1010. According to one aspect of the invention, mounting device 1010 may be similar in structure and function to device 500 shown in FIGS. 57 and 58. As shown in FIG. 66, device 1010 comprises a plurality of spines, rods, or bars 1011 and may or may not include one or more mounting means (not shown), for example, mounting means 514 of FIG. 57. In one aspect of the invention the mounting means may comprise a ring, a loop, a hook, or related structure. In one aspect of the invention, device 1010 may include structures similar to the structure of device 500 shown in FIGS. 57 and 58. For example, device 1010 may typically include a plurality of mounting posts or pins 1015, similar to mounting posts 508 in FIG. 57. In the aspect of the invention shown in FIG. 66, the mounting posts 1015 may be adapted to mount ornaments 1005 in one or more rows 1001. In the aspect of the invention shown in FIG. 66, the mounting posts 1015 may be adapted to mount ornaments 1005 in a series of parallel rows wherein adjacent ornaments 1005 may be positioned generally in line with each other, for example, wherein the centerlines of adjacent ornaments are generally in line with each other. Similar to the earlier aspects of the invention, posts 1015 may be adapted to retain ornaments 1005, for example, posts 1015 may be kinked or otherwise bent to provide an obstruction to the removal of ornaments 1005. In one aspect, device 1010 may be made from one or more of the metals or plastics discussed above and may be fabricated from plate, as discussed for other aspects of the invention, for example, from one or more of the machining processes discussed above, for example, by laser cutting from plate. In one aspect, after device 1010 may be fabricated from plate, posts 1015 may be deflected out of the plane by spines 1011. For example, in one aspect, posts 1015 may be plastically deflected in the vicinity of their intersection with spine 1011 to provide a mounting for ornaments 1005. In another aspect, spines 1011 may be rotated relative to mounting means (not shown) at either end of device 1010 to deflect post 1015 relative to the plane of spines 1011, for example, plastically twisted between the end most mounting post 1015 and the mounting means.

FIG. 67 is a perspective view of an ornament arrangement 1100 having a plurality of rows 1101 of ornaments 1105. In the aspect shown in FIG. 66 ornaments 1105 comprise ornamental faceted spheres, though any of the ornaments discussed above may be used. Though three rows 1101 are illustrated, according to one aspect of the invention two or more, or 5 or more, rows 1101 of ornaments 1105 may be provided. Arrangement 1100 is very similar is arrangement 1000, having many of the structures and functions of arrangement 1000. However, arrangement 1100 differs from arrangement 1000 in that in arrangement 1100 shown in FIG. 67, the mounting posts may be adapted to mount ornaments 1105 in a staggered arrangement, for example, wherein the centerlines of adjacent ornaments 1105 do not line up or coincide. In one aspect, the centerlines of ornaments are positioned midway between the centerlines of adjacent ornaments. In essentially, all other aspects, arrangement 1100 is similar to arrangement 1100.

In contrast to prior art ornament arrangements and methods of assembly, ornament arrangements and methods of the present invention, for example, those shown in FIGS. 24, 25, 37, 38 and 57, through holes 78 of ornaments 62 or 77 and through holes 520 of ornaments 518 may not lie on the centerline of the ornament. That is, contrary to the prior art, apertures or through holes 78 on adjacent ornaments are not positioned adjacent to each other, for example, as shown in the ornament assemblies of FIGS. 1 through 4. In one aspect of the invention, ornaments 62 or 77 have only two apertures. In contrast to the prior art and according to aspects of the present invention, ornaments 62 and 77 are rotated about 90 degrees from their conventional orientation whereby the location of their apertures are rotated about 90 degrees from their conventional orientation.

Among the advantages of the present invention over the prior art, aspects of the present invention have the following advantages when compared to the prior art:

1. The loading on each connector is reduced: According to aspects of the invention, having two connectors 70 or related connecting means located between adjacent ornaments, for example, on ornaments 62 and 77, reduces the tensile load on each connector and each ornament, for example, on each perforation in the ornament, and thus minimizes or prevents connector or ornament failure. For example, in one aspect, the tensile load per connector is reduced by about 50%. Conversely, according to one aspect of the invention, the use of two connectors or related structures between ornaments allows the designer to use larger, heavier ornaments than can be used with prior art connectors. In one aspect of the invention, the load carrying capacity of an ornament chain having connectors 70 and 90, and hook 80, may be at least 5 times greater than the load carrying capacity of ornament chains assembled using prior art connectors and hooks.

2. Ornament loaded-thickness is increased: According to aspects of the invention, for example, as shown in FIG. 25 or 37, the thickness of the ornament 62 from the point of loading at hole 78 to the surface of the ornament in the direction of loading is thicker than the corresponding thickness in the case of the prior art. For example, when the ornament is made of glass, the thickness of the glass between the perforation 78 and the edge of the ornament shown in FIG. 25 is greater than the thickness between the perforation and the edge of the typical prior art loading shown in FIGS. 2 and 4. Thus, compared to the prior art, aspects of the present invention are less prone to ornament failure due, for example, to cracking of this thickness between the mounting hole and the edge of the ornament.

3. Reduced tendency to disengage: According to aspects of the invention, for example as shown and described with respect to FIG. 12, the legs of connectors 70 and 90 and hook 80 and related structures, such as frames, are bent over their respective ornaments at an angle that is about 90 degrees to the direction of loading. This perpendicular bending of the connector, prevents or minimizes the potential for the connector to disengage from the ornament when under load, compared to prior art connectors, for example, those shown in FIGS. 1 through 5.

4. Pivoting of ornaments is minimized: According to aspects of the present invention, the double connector, "ladder-type" structure, for example, as shown in FIGS. 25 and 58, is less prone to twisting or misalignment of the ornaments compared to single connector, centerline mounting configurations typical of the prior art, for example, as shown in FIGS. 1 through 5.

Thus, aspects of the present invention provide ornament connectors and mounting hooks and methods for connecting ornaments that address many of the disadvantages of the prior art. In particular, aspects of the present invention, allow the fixture or chandelier designer to accommodate customer demands for larger fixtures and chandeliers having larger and heavier ornaments and longer ornament chains by providing connectors and hooks that can withstand the loading and minimize or prevent the twisting that can be encountered in larger fixtures and chandeliers.

As will be appreciated by those skilled in the art, features, characteristics, and/or advantages of the ornament connectors and hooks described herein, may be applied and/or extended to any embodiment (for example, applied and/or extended to any portion thereof).

Although several aspects of the present invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims and their equivalents.

We claim:

1. A method of assembling at least a first decorative ornament having at most a first aperture and a second aperture and a second decorative ornament having at most a first aperture and a second aperture, the method comprising:

inserting a first end of a first connector into the first aperture of the first ornament and bending the first end to engage the first aperture of the first ornament;

inserting a second end of the first connector into the first aperture of the second ornament and bending the second end to engage the first aperture of the second ornament;

inserting a first end of a second connector into the second aperture of the first ornament and bending the first end to engage the second aperture of the first ornament; and inserting the second end of the second connector into the second aperture of the second ornament and bending the second end to engage the second aperture of the second ornament.

2. The method as recited in claim 1, wherein each of the first connector and the second connector comprises one of a wire, a rod, a pin, and a post.

3. The method as recited in claim 1, wherein the method comprises a method of assembling a chain of ornaments.

4. The method as recited in claim 3, wherein the method provides a chain having reduced load on the first and second connectors compared to a load on a single connector between the ornaments.

5. The method as recited in claim 4, wherein the method provides a chain having about 50% reduced load on the first and second connectors compared to the load on the single connector between the ornaments.

6. The method as recited in claim 3, wherein the chain comprises at least 3 ornaments.

7. The method as recited in claim 6, wherein the at least 3 ornaments comprise octagonal ornaments, each octagonal ornament consisting of two apertures.

8. The method as recited in claim 1, wherein after bending the first end of the first connector to engage the first aperture of the first ornament, the method further comprises terminating the first end of the first connector.

9. The method as recited in claim 1, wherein after bending the first end of the second connector to engage the second aperture of the first ornament, the method further comprises terminating the first end of the second connector.

10. The method as recited in claim 1, wherein the method further comprises fabricating the first and second connectors from plate.

11. The method as recited in claim 9, wherein fabricating the first and second connectors from plate comprises laser cuffing at least one of the first and second connectors from plate.

12. The method as recited in claim 1, wherein a load on the first decorative ornament is substantially evenly distributed between the first aperture and the second aperture.

* * * * *

UNITED STATES PATENT AND TRADEMARK OFFICE

CERTIFICATE OF CORRECTION

PATENT NO. : 7,318,280 B2
APPLICATION NO. : 11/048144
DATED : January 15, 2008
INVENTOR(S) : Bayer et al.

It is certified that error appears in the above-identified patent and that said Letters Patent is hereby corrected as shown below:

In the Assignee:

Please delete "Schnobek Worldwide Lighting Inc." and insert -- Schonbek Worldwide Lighting Inc. --

In the claims:

Claim 11, Col. 30, line 46, delete "cuffing" and insert -- cutting --

Signed and Sealed this

Eleventh Day of March, 2008

JON W. DUDAS
*Director of the United States Patent and Trademark Office*